US005988317A

United States Patent [19]

Riding

[11] Patent Number: 5,988,317

[45] Date of Patent: Nov. 23, 1999

[54] MODULAR HINGED SCAFFOLD UNIT

[76] Inventor: Gary Riding, 522 S. 500 East, Santaquin, Utah 84655

[21] Appl. No.: 09/287,306

[22] Filed: Apr. 7, 1999

Related U.S. Application Data

[63] Continuation-in-part of application No. 09/157,606, Sep. 21, 1998, abandoned.

[51] Int. Cl.[6] ..... E04G 1/34

[52] U.S. Cl. ..... 182/152; 182/178.5; 182/186.6

[58] Field of Search ..... 182/152.1, 186.6, 182/178.5, 223, 141

[56] References Cited

U.S. PATENT DOCUMENTS

| | | | |
|---|---|---|---|
| 2,599,670 | 6/1952 | Thomas | 304/29 |
| 3,213,964 | 10/1965 | Tucker et al. | 182/223 |
| 3,498,412 | 3/1970 | Best . | |
| 3,690,407 | 9/1972 | Cullison | 182/223 X |
| 4,534,447 | 8/1985 | Champigny . | |
| 4,883,147 | 11/1989 | Davison et al. . | |
| 5,069,309 | 12/1991 | Swiderski et al. | 182/186.6 X |
| 5,099,953 | 3/1992 | Stegath . | |
| 5,579,866 | 12/1996 | Rowell . | |

*Primary Examiner*—Daniel P. Stodola
*Assistant Examiner*—Hugh B. Thompson
*Attorney, Agent, or Firm*—Workman Nydegger Seeley

[57] ABSTRACT

A modular foldable scaffold with hinged structures that can be easily assembled, disassembled and compactly stored. The three main components of the scaffold are modular end ladders, a modular support platform and modular stabilizing members. A clamping assembly at each end of the stabilizing members can be set to permit the pivoting of the stabilizing members with respect to the end ladder legs, thus allowing the scaffold to adopt any one of a variety of collapsed configurations in which the scaffold can be relocated through narrow passages without having to disassemble it.

28 Claims, 15 Drawing Sheets

MODULAR HINGED SCAFFOLD UNIT

This application is a continuation-in-part patent application of U.S. patent application Ser. No. 09/157,606 filed by Gary Riding on Sep. 21, 1998, now abandoned. U.S. patent application Ser. No. 09/157,606 is hereby incorporated in its entirety.

BACKGROUND OF THE INVENTION

1. The Field of the Invention

This invention relates to movable support frameworks. More specifically, this invention relates to foldable scaffolds.

2. Present State of the Art

Masonry and carpentry are two of many jobs that require the use of scaffolds. Scaffolds assist workers by allowing them to work in elevated positions. However, scaffolds have several challenges. Scaffolds must be transported to and from the workplace. Scaffolds must be assembled and disassembled. Additionally, scaffolds must be stored when they are not in use. All of these activities require time, and these conditions are compounded when the work area is small and confined or when a scaffold is moved from location to location through narrow openings. Any time a scaffold is moved, whether it be from one workplace to another or simply to another location at the same workplace, an additional assembly and reassembly of the scaffold is required.

With a conventional scaffold, the scaffold must be disassembled and then reassembled as the work location requires. The economic impact on the employer is profound, as the workers must be paid for their time. An employer would prefer to pay workers for work done on an employer's contractual obligations, rather than for time spent transporting, assembling, disassembling and storing scaffolds. Further, a project is delayed by the time workers spend transporting, assembling, disassembling and storing scaffolds. One significant advantage of conventional scaffolds is that they are rigid and enable workers to be securely supported.

The prior art discloses foldable scaffolds that have attempted to solve the time consuming problems presented by conventional scaffolds while maintaining sufficient rigidity. U.S. Pat. No. 5,099,953, issued to Stegath, discloses a foldable scaffold that has two end ladders and one horizontal truss. The truss has as many as four locations where the scaffold must pivot in order to fold. One pivot exists at each ladder post and the truss has a gate portion with two pivots. The scaffold folds like an accordion. The simplest configuration of this scaffold only has three sides. In an effort to maintain rigidity, the supporting planks are securely fastened to the rungs of an end ladder. A workman typically attaches the planks to the uppermost rung. In that case, one entire side of the scaffold has horizontal stability only at the top of the end ladder, while the lower portion of the scaffold no longer has rigidity because it has no stabilization. Another aspect of this scaffold is that it is one permanently connected piece. The truss is permanently connected to an end ladder. The scaffold is essentially one integral component and this aspect makes the scaffold difficult to store compactly and efficiently for two reasons. First, the folded scaffold is large and the truss and end ladders are free to rotate. Second, the scaffold, in its folded position, has an awkward shape.

U.S. Pat. No. 5,069,309, issues to Swiderski et al., discloses a rolling tower scaffold that has two end ladders and a horizontally extending support platform which is adjustably mounted between the end ladders. This platform is supported by a frame that has carriage rails that slidably engage the end ladders. The engagement of the carriage rails to the end ladders is such that it only allows for motion of the carriage rails along the vertical rails of the end ladders, but no rotation of the frame with respect to the end ladders is allowed. In this configuration, the tower scaffold must be disassembled when it has to be moved through an opening that is narrower than the end ladders. In other words, the fully assembled configuration of the tower scaffold disclosed in this patent cannot be distorted into shapes other than the fully assembled working configuration. Furthermore, the tower scaffold disclosed in this patent cannot be configured as a stair scaffold because the frame that supports the platform is attached to the vertical rails of the end ladders and thus its width is determined by the width of the end ladders. More generally, the frame that supports the platform and the frame attachment to the end ladders provide the structural stability in addition to the support for the platform of the tower scaffold disclosed in this patent.

Similarly, the scaffolds disclosed n U.S. Pat. No. 3,690,407 to Cullison and U.S. Pat. No. 3,213,964 to Tucker must be disassembled when they have to be moved through an opening that is narrower than the ladder ends.

U.S. Pat. No. 4,534,447, issued to Champigny, is for a scaffold similar to the scaffold invented by Stegath. The Champigny scaffold also has two end ladders and one horizontal truss. The Champigny truss has a pivot at each leg post and one pivot or folding configuration in the center, whereas the Stegath scaffold has two pivots in the center portion of the truss. The center pivot of Champigny folds towards the center of the scaffold as the end ladders are pushed together. This scaffold presents the same problems apparent in Stegath. The scaffold only has three sides. The horizontal stability for the fourth side is provided by the planks, which are usually attached to the uppermost ladder rung. Thus this scaffold loses the rigidity found in conventional scaffolds. Also, the Champigny scaffold is one, permanently connected unit, which makes storage difficult and inefficient.

U.S. Pat. No. 3,498,412 issued to Best, discloses a foldable scaffold with similar problems. This scaffold has four sides, but the horizontal sides are connected to the end ladders by swivel sleeves, which are free to rotate at all times including when the scaffold is in use. The scaffold is braced only by the placement of the top platform, which leaves the bottom portion of the scaffold less rigid and less secure. The Best scaffold is also intended to be permanently connected by bolts and disassembly of the Best scaffold would require much valuable time. Because the Best scaffold is permanently connected, the scaffold has an awkward and space consuming shape when in a folded position. Storage of the Best scaffold, like storage of the scaffolds previously discussed, is again difficult and inefficient.

U.S. Pat. No. 2,599,670 issued to Thomas, discloses a scaffold with four sides. Each side is connected to a post in a manner that permits the post to rotate freely. The post is able to rotate freely when the scaffold is in use. Rotation of the post is prevented by a top mounted support plank. The support plank is the only means of stabilization. The support planks are merely held in by clips and are placed at the top of the scaffold. The Thomas scaffold is also one permanently connected piece which makes storage difficult and inefficient.

Essentially, the prior art of foldable scaffolds has attempted to satisfy the demands of quick and easy assembly, simple disassembly, and compact storage while maintaining rigidity. The scaffolds are difficult to store because the shape of the folded scaffolds do not enable efficient stacking and are awkward to handle. The prior art scaffolds are easy to assemble in one unit, but rigidity and stability have been sacrificed. Rigidity and stability are sacrificed by having only three sides or by the location of the stabilizing members at the top of the scaffold.

Stacking scaffold units which are permanently attached makes assembly and disassembly very difficult. Each unit is heavier to lift, and the various pivots make lifting and orienting the scaffold awkward and time consuming. Further, as the units are stacked to provide greater elevation, the lack of rigidity in the bottom portions of the scaffold units is magnified by the increased weight and height of the scaffold structure. Also, because the prior art scaffolds rely on the support planks to provide stability, those planks will have to be left in place as the scaffold is made larger. Thus, many planks will have to be brought to the workplace, and the primary function of the plank, which is providing a worker a place to work, will be lost. A worker may also be wary of ascending a tall scaffold with only three sides or a scaffold that is free to rotate.

SUMMARY AND OBJECTS OF THE INVENTION

It is, therefore, an object of the present invention to provide a scaffold that is quickly and easily assembled and disassembled.

Another object of the present invention is to provide a scaffold that is compactly and efficiently storable.

A further object of the present invention is to provide a scaffold that is modular.

Another object of the present invention is to provide a scaffold that is foldable to permit quick relocation of the scaffold while still providing stability, rigidity and safety when the scaffold is ready for use. In any one of a plurality of folded or collapsed configurations, the width of the scaffold is changed as desired with the aid of hinged structures.

Yet another object of the present invention is to provide a scaffold wherein the scaffold can be configured to many different uses.

Additional objects and advantages of the invention will be set forth in the description which follows, and in part will be obvious from the description, or may be learned by the practice of the invention. The objects and advantages of the invention may be realized and obtained by means of the instruments and combinations particularly pointed out in the appended claims.

To achieve the foregoing objects, and in accordance with the invention as embodied and broadly described herein a collapsible or foldable scaffold is provided. The foldable scaffold solves the long felt need of quick assembly, easy disassembly, movability, and efficient storage, while maintaining the rigidity and stability of conventional scaffolding. The present invention can be arranged in many different configurations. All of the components of this invention are modular. Once assembled, the scaffold has the advantage of being easily ascended.

The scaffold has three main components: modular end ladders, a modular support platform and modular stabilizing members. The components are connected in the following manner. End ladders are set apart facing one another. A stabilizing member is removably attached to one leg of each end ladder. Another stabilizing member is similarly attached to the other side of the scaffold. Each stabilizing member has a clamping assembly located at each opposing end. The clamping assemblies removably connect to the end ladder legs and are capable of preventing the scaffold from rotating or folding. The clamping assemblies may also be loosened to permit the scaffold to be folded and relocated without completely disassembling the scaffold. The modularity of the stabilizing members allow more stabilizing members to be added to the scaffold structure if additional rigidity or support is needed. The clamping assemblies fit snugly between end ladder rungs to provide additional rigidity and stability.

The support platform comprises one or more support members. Each support member has two opposing ends and each end is configured to removably connect to a rung of an end ladder. The support platform provides a work area to workers when attached to the end ladders. Note that a stabilizing member can be used as a support member when the clamping assemblies are attached to an end ladder rung rather than an end ladder leg.

The end ladders are rectangular in shape which permits them to be stacked and stored efficiently. The horizontal stabilizing members are modular and can be stored in a similar fashion. The support members also have the same characteristic. The invention, when disassembled does not have an awkward shape, but has a substantially flat shape that lends itself to compact storage.

This invention can also be quickly assembled to greater elevations. The end ladders can be stacked upon one another and the stabilizing members are simply attached at the needed intervals. The modular end ladders and stabilizing members are relatively lightweight and are not awkward to manipulate. Once in place, rigidity is assured. Disassembly is also a quick and easy process.

This scaffold has four sides and is also capable of being easily moved without complete disassembly. By loosening the clamping assembly located at the end of each stabilizing member, the scaffold can be folded and moved through narrow openings. The scaffold also has castor wheels to aid in this process. Once the scaffold is at the new location, the scaffold is unfolded, the clamping assembly is tightened, and a rigid scaffold is in place.

These and other objects and features of the present invention will become more fully apparent from the following description and appended claims, or may be learned by the practice of the invention as set forth hereinafter.

BRIEF DESCRIPTION OF THE DRAWINGS

In order that the manner in which the above-recited and other advantages and objects of the invention are obtained, a more particular description of the invention briefly described above will be rendered by reference to specific embodiments thereof which are illustrated in the appended drawings. Understanding that these drawings depict only typical embodiments of the invention and are not therefore to be considered limiting of its scope, the invention will be described and explained with additional specificity and detail through the use of the accompanying drawings in which.

DETAILED DESCRIPTION OF THE PREFERRED EMBODIMENTS

Figure 1:
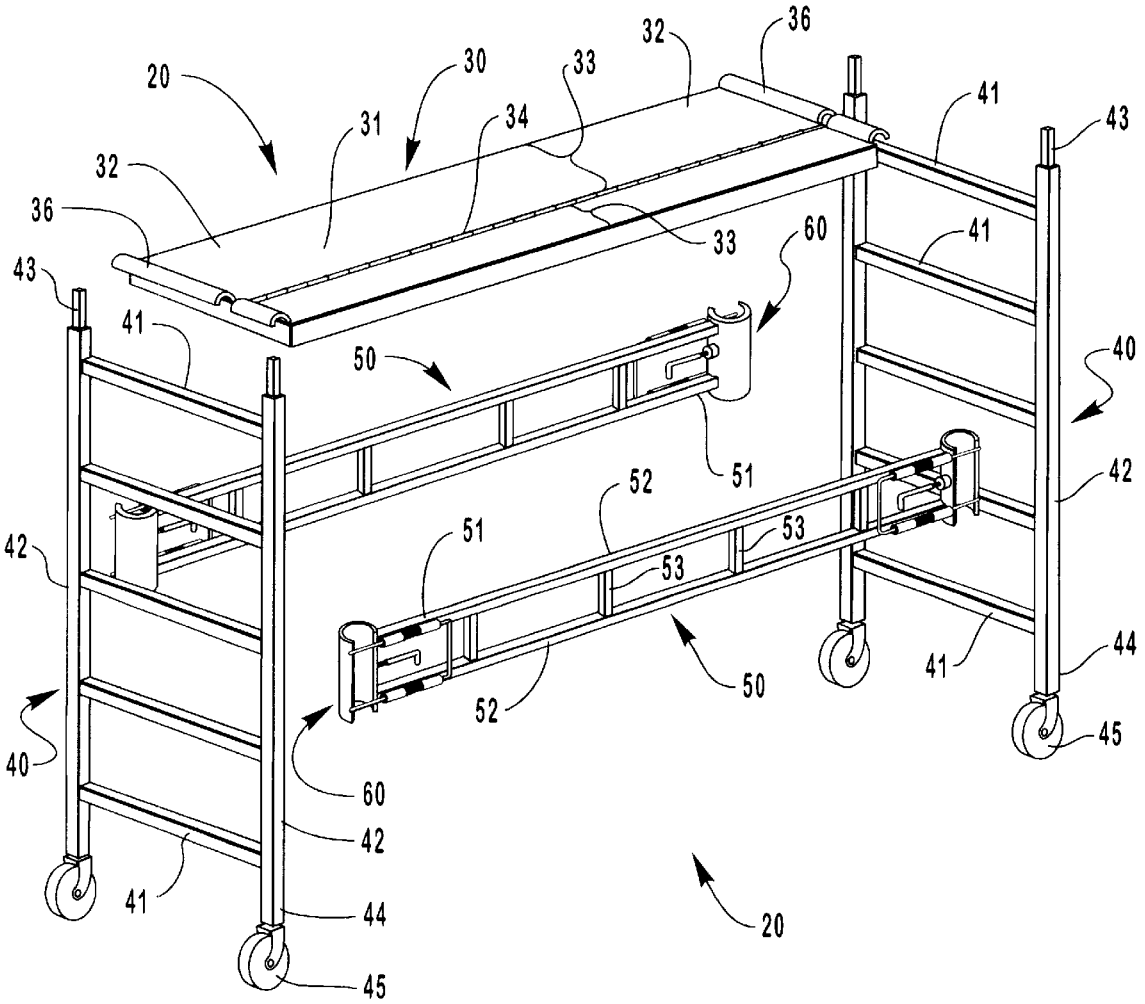
FIG. 1 illustrates a perspective view of the foldable scaffold and its modular parts.

FIG. 1 illustrates a preferred embodiment of the present invention, a modular folding scaffold 20. Scaffold 20 has three main components: modular end ladders 40; a modular support platform 30; and modular stabilizing members 50 with a clamping assembly located at each end of each stabilizing member. Each of these modular components will be discussed in turn.

Figure 2:
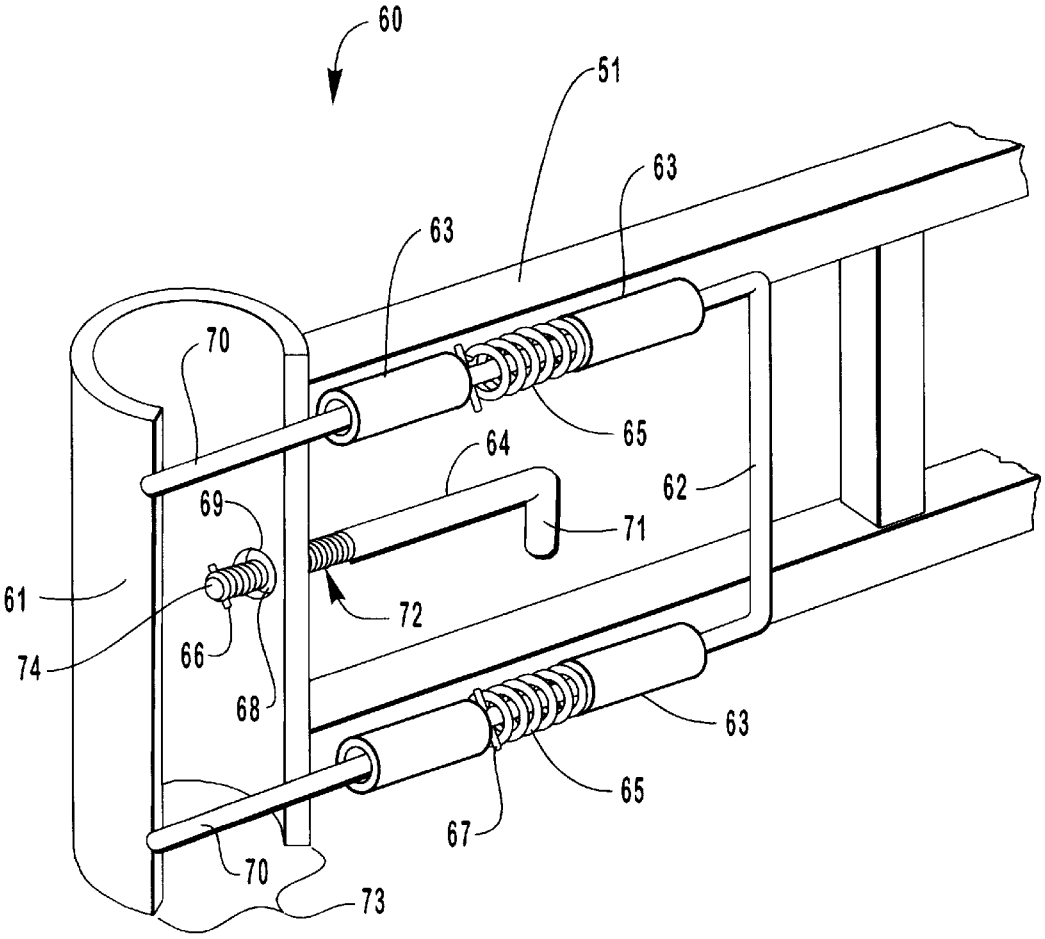
FIG. 2 illustrates a perspective view of an embodiment of a clamping assembly attached to the end of a stabilizing member where the jacket retention pin is embodied by a pin that is mated with a threaded aperture.
Figure 3:
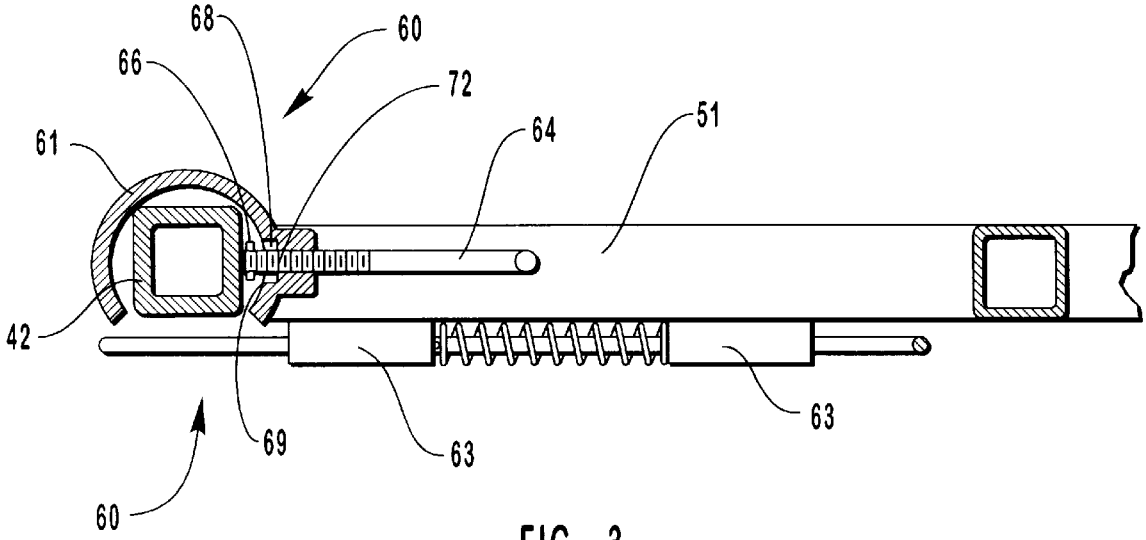
FIG. 3 illustrates a top plan cross section of FIG. 2.
Figure 6A:
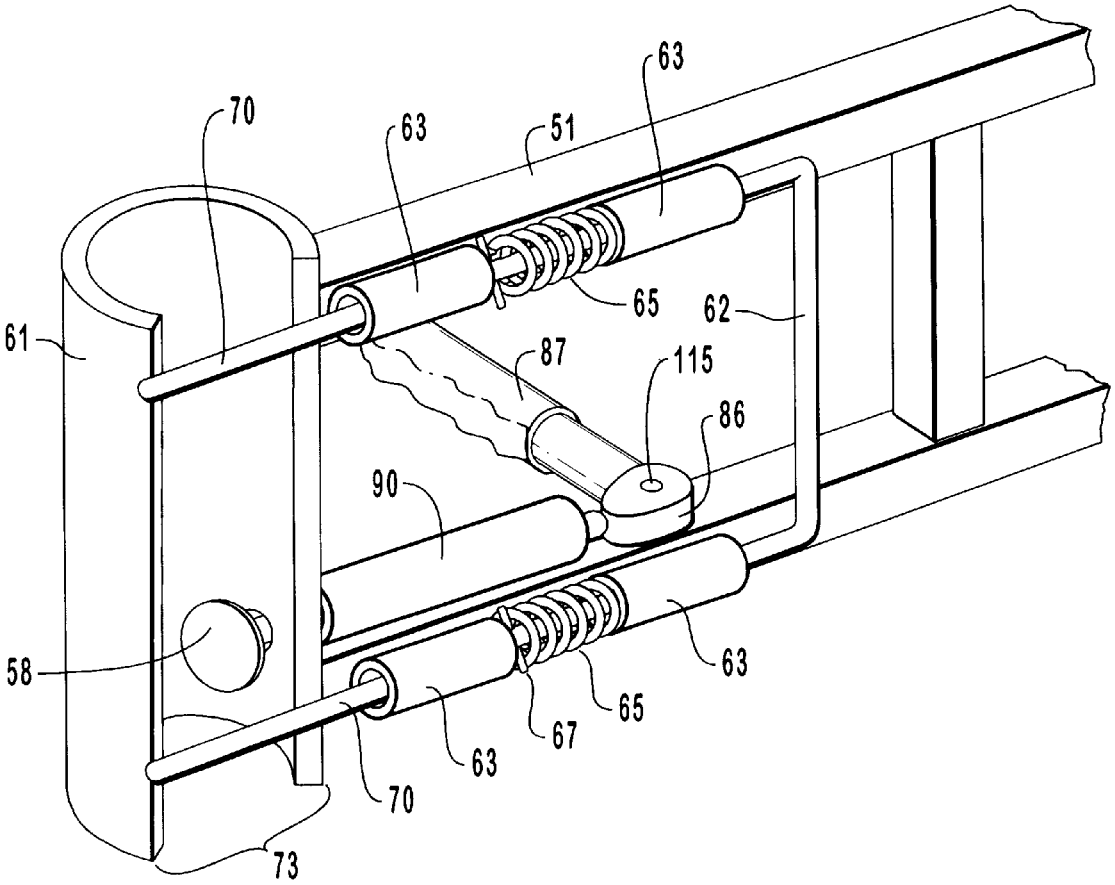
FIG. 6A illustrates a perspective view of an embodiment of the clamping assembly attached to the end of a stabilizing member, where the jacket retention pin is embodied by a spring loaded pin with a plate at one end.
Figure 6B:
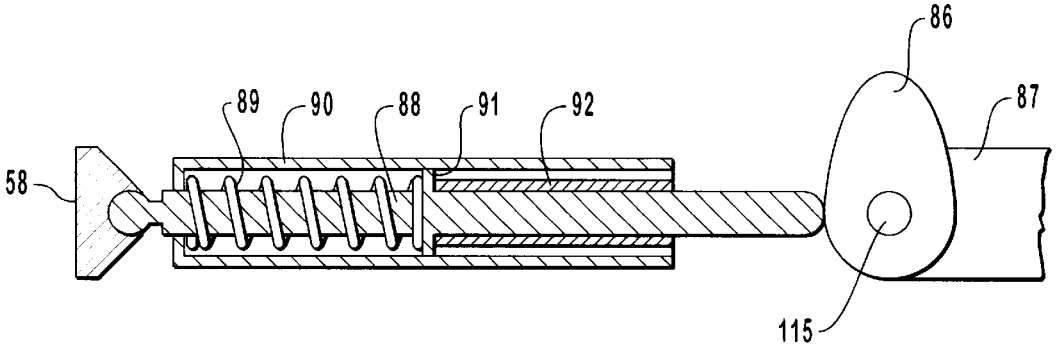
FIG. 6B illustrates a partial cross-sectional view of a pin and cam-lever system like the system shown in FIG. 6A, where the lever is positioned to release the contact engagement between the end of the pin and the jacket.
Figure 6C:
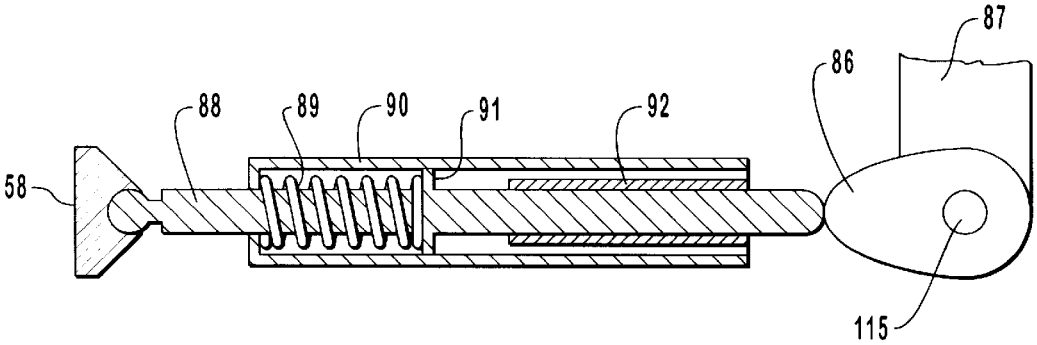
FIG. 6C illustrates a partial cross sectional view of a pin and cam-lever system like the system shown in FIG. 6B, where the lever is in a locking position.
Figure 6D:
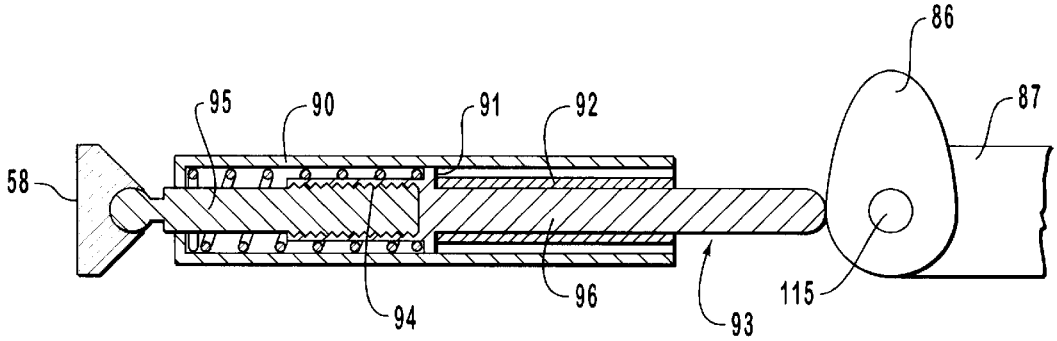
FIG. 6D illustrates a partial cross-sectional view of a pin and cam-lever system like the system shown in FIG. 6B with an adjustable length pin.
Figure 7:
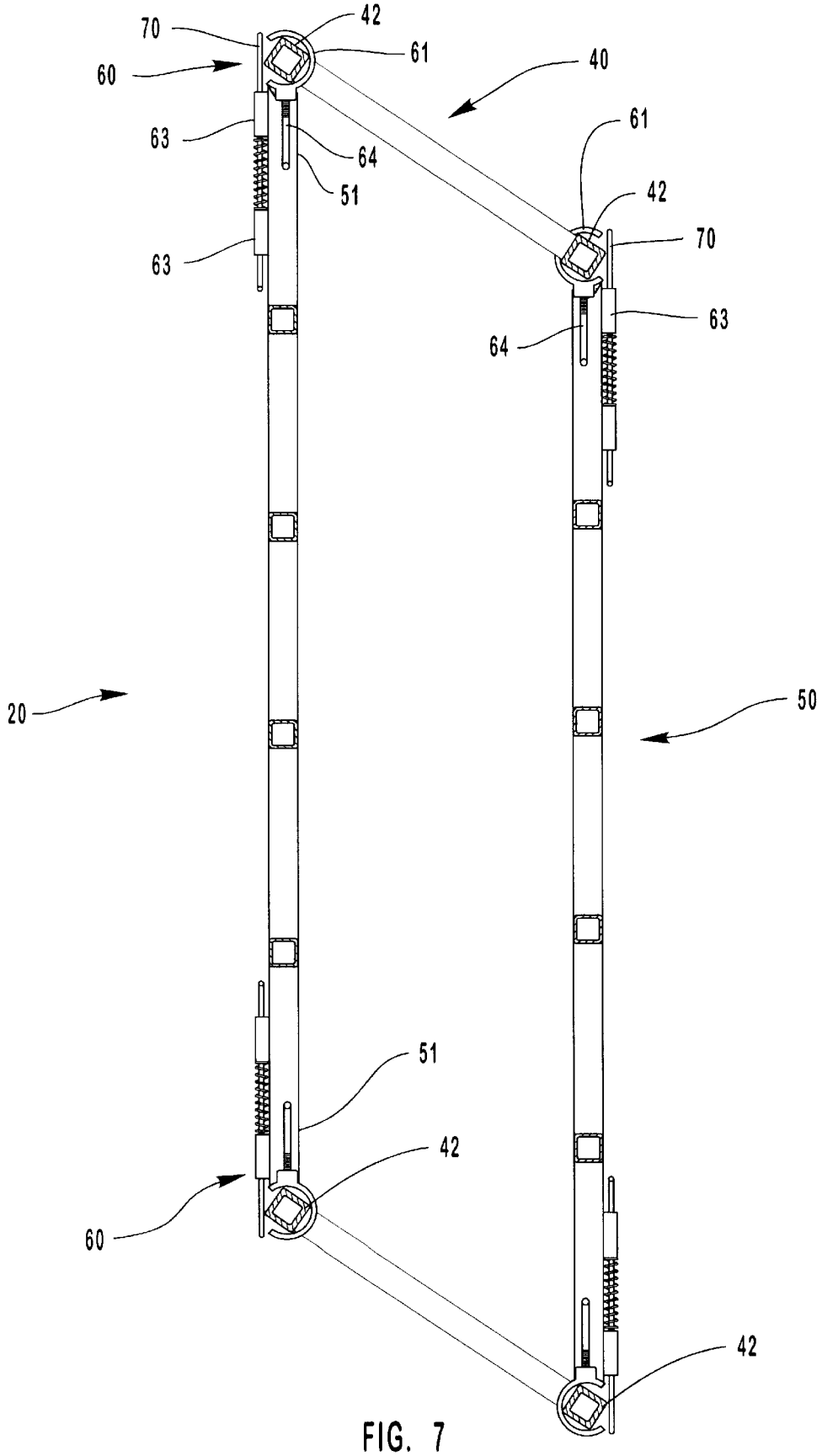
FIG. 7 illustrates a top plan view of the foldable scaffold and illustrates how the scaffold folds.

The exploded perspective view of the embodiment illustrated in FIG. 1 is shown assembled and ready for use in FIG. 7. FIG. 6 depicts scaffold 20 in a collapsed position. The ability of the scaffold to collapse enables the scaffold to be easily moved through doorways as the scaffold is moved. FIGS. 2–3 depict clamping assembly 60 which couples around ladder leg 42 of end ladder 40 to enable the hinge action shown in FIG. 6 to occur, and FIGS. 4 and 5 show other embodiments of the clamping assembly of the scaffold of this invention.

Figure 8:
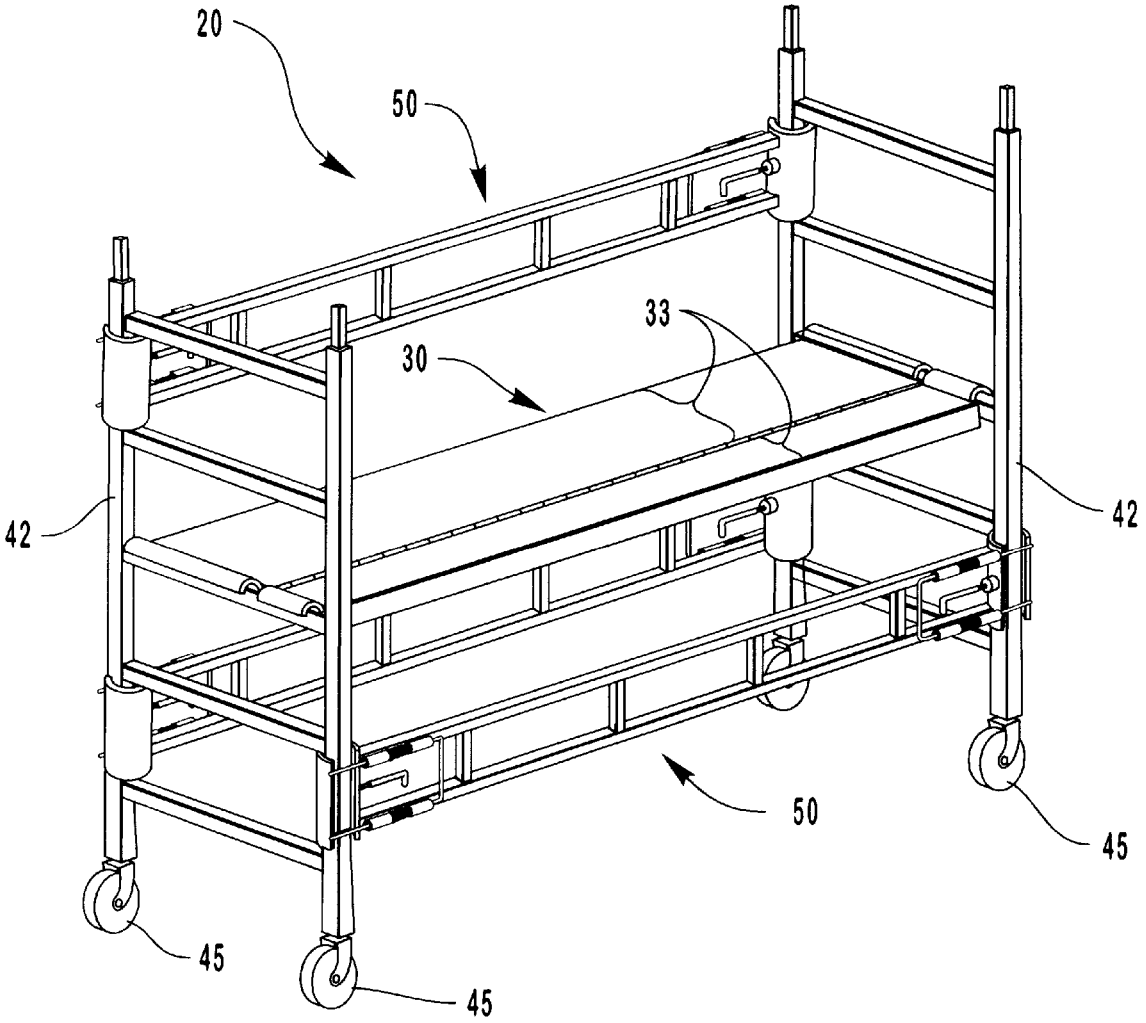
FIG. 8 illustrates a perspective view of the foldable scaffold in a certain configuration.
Figure 9:
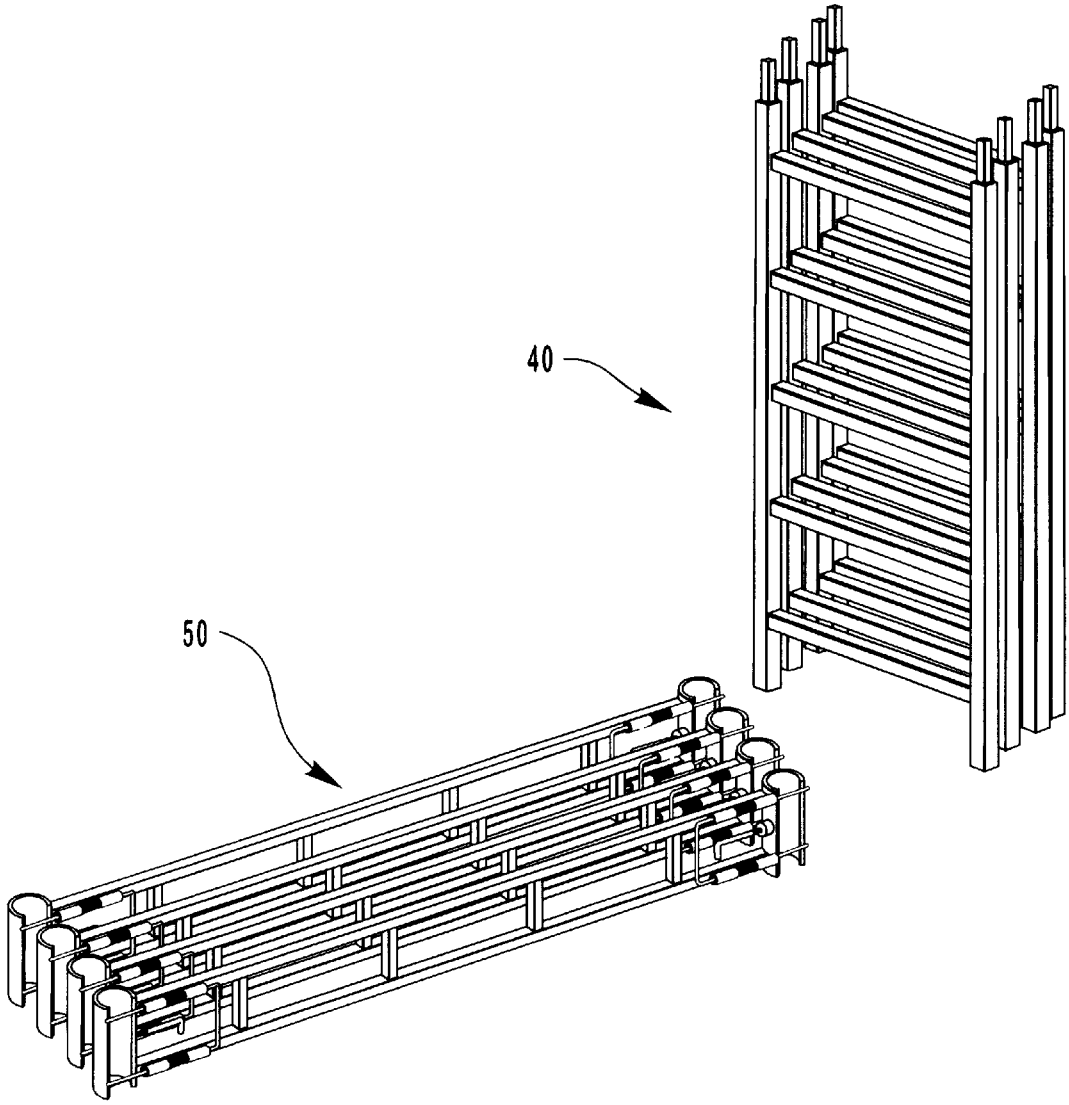
FIG. 9 illustrates a perspective view of the stackability and modularity of the end ladders and stabilizing members.
Figure 10:
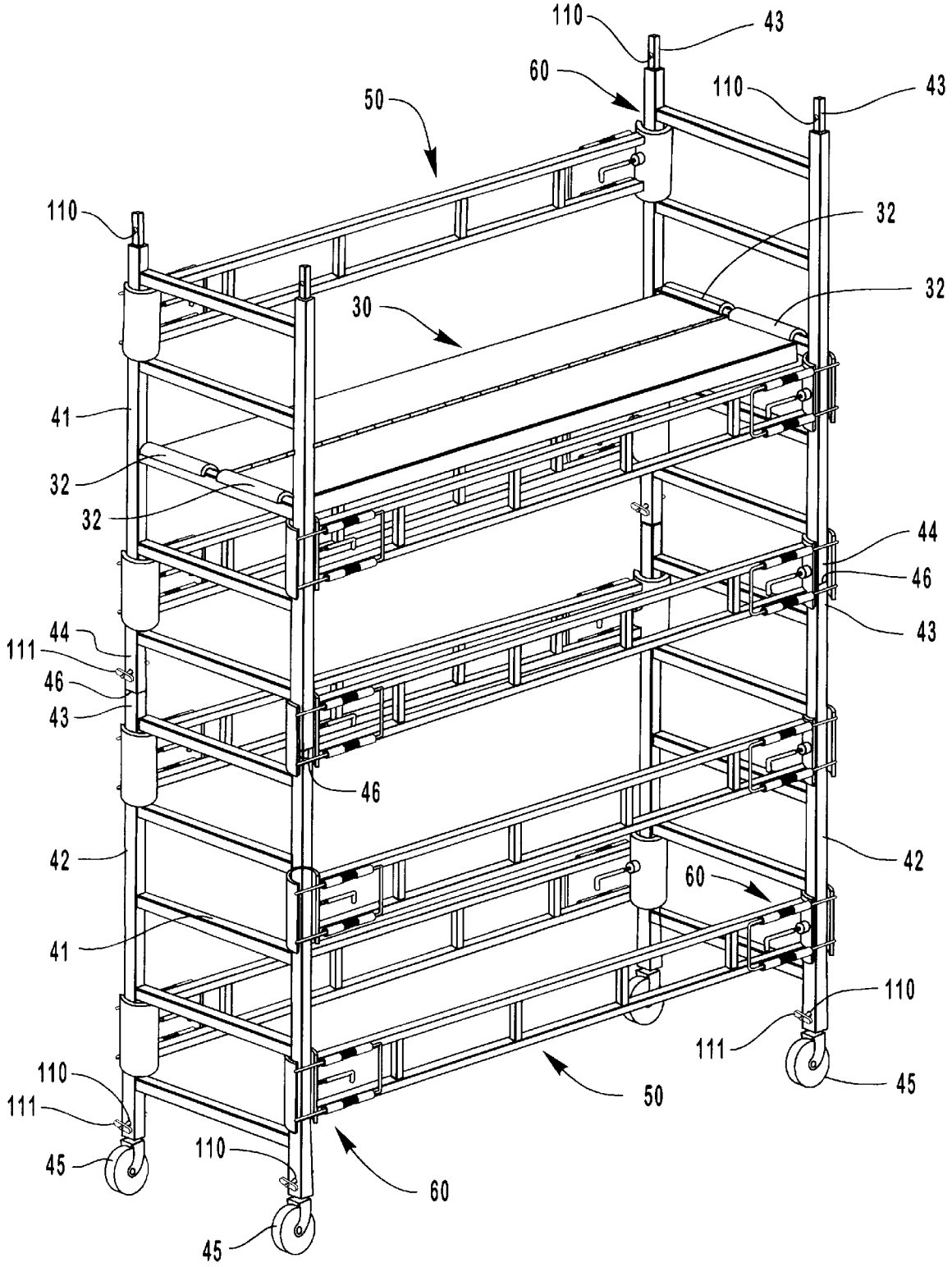
FIG. 10 illustrates a perspective view of the foldable scaffold in an elevated configuration.
Figure 11:
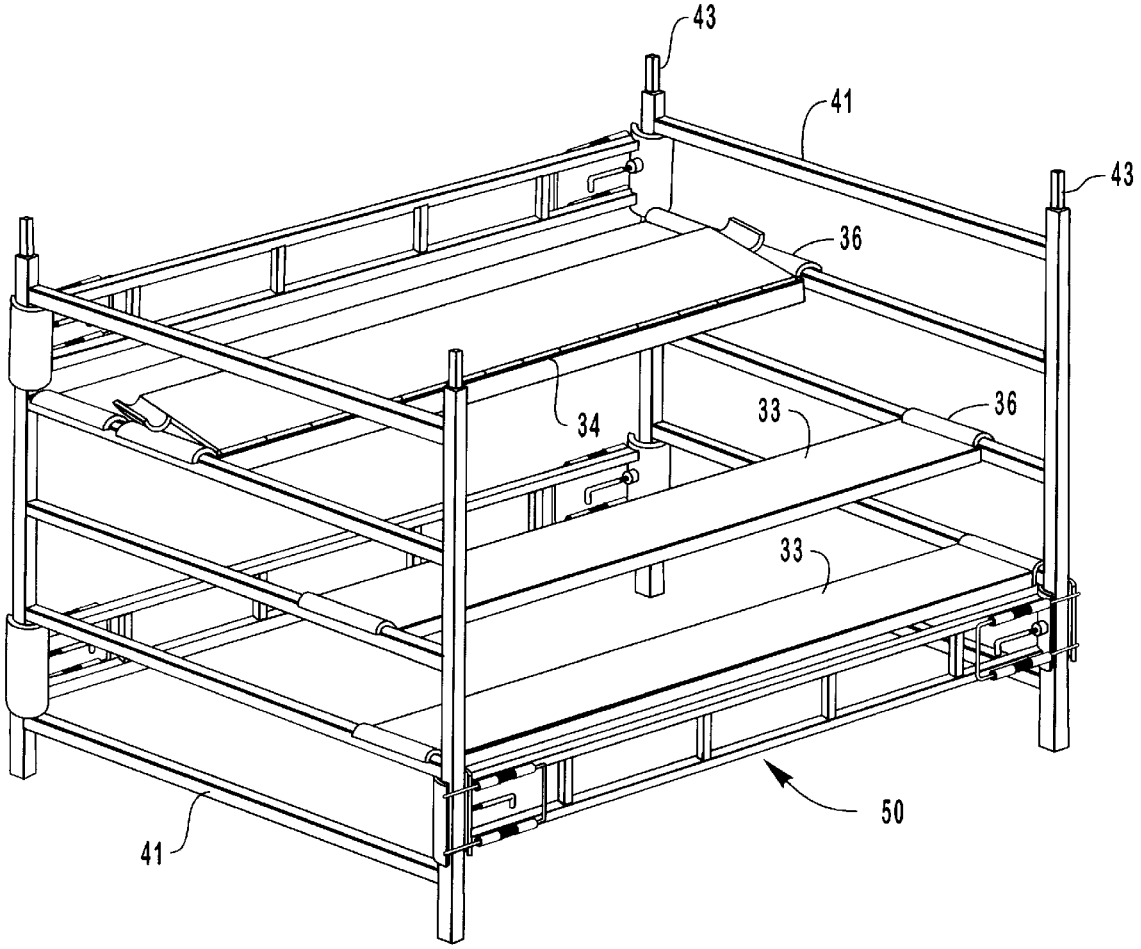
FIG. 11 illustrates a perspective view of the foldable scaffold in a step configuration.
Figure 12:
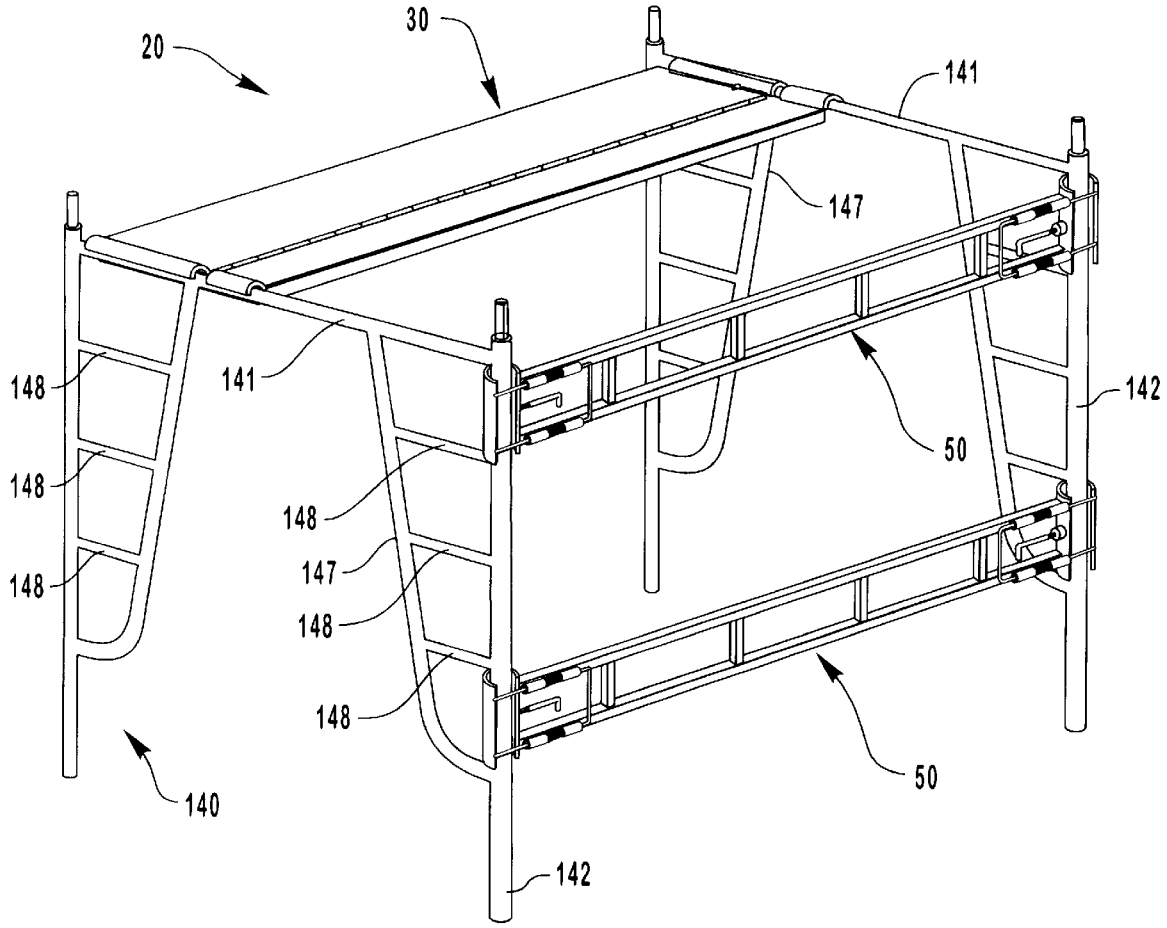
FIG. 12 illustrates a perspective view of another embodiment of the foldable scaffold.

FIG. 8 shows the disassembled scaffold as it could be stored when not in use either in a fully operational or collapsed position. FIG. 9 illustrates an embodiment of the scaffold of this invention in a stacked configuration. FIGS. 10–12 shown other embodiments of the scaffold of this invention.

Each modular end ladder 40 is comprised of a plurality of horizontal rungs 41 extending horizontally between two ladder legs 42. The length of rungs 41 depends on the particular design of the invention. Each ladder leg 42 of each end ladder 40 has a top end 43 and a bottom end 44. Ladder leg 42 may have any suitable cross sectional shape, however, the preferred cross sectional shape of ladder leg 42 is square.

End ladders 40 are preferably configured to enable scaffold 20 to be stacked on another scaffold 20. The embodiment shown in FIG. 1 enables scaffold 20 to support another scaffold via the configuration of the top ends 43 and the bottom ends 44 of ladder legs 42.

In the embodiment depicted in FIG. 1, the support platform shown at 30 has a substantially flat surface 31 and two opposing ends 32. As described herein below, support platform 30 may be two support members 33 as shown or a single support member 33. Each opposing end 32 is configured to engage an end ladder rung 41 such that the support platform 30 extends horizontally between two end ladders 41. Each opposing end 32 of support platform 30 is preferably configured for attachment to any end ladder rung 41. However, the opposing ends may just rest on end ladder rungs 41, which may occur when the support platform 30 is embodied as a plank of wood.

The embodiment illustrated in FIG. 1 depicts each end 32 with a semicircular lip 36. Lip 36 extends out from end 32 of each support member 33. Lip 36 attaches to end ladder rung 41 by partially encircling the end ladder rung 41. The edge of lip 36 furthest from substantially flat surface 31 falls below the top surface of end ladder rung 41. This partial encircling of end ladder rung 41 by lip 36 prevents end ladder 40 from shifting laterally. Lip 36 also prevents support platform 30 from moving laterally while in use.

Lip 36 is an example of attachment means for removably connecting the support platform to a rung of an end ladder. The attachment means may have any suitable shape. For example, end 32 may have a right angle lip, which has a portion extending out from the support platform and a second portion extending perpendicularly from the first portion. Such a right angle lip attaches securely to end ladder rung 41 and also prevents end ladder 40 from moving laterally as the first portion rests on the top surface of rung 41 while the second portion braces against the external side surface of rung 41. Similarly, the attachment means may be grooves located on the underside of the ends of a support member such that the ends of the support member extend beyond the end ladder rungs with the grooves resting on the rungs. Thus, the attachment means may be an integral feature of the support platform or an attached component.

The support platform shown at 30, comprises two support members 33. However, as previously indicated, the support platform may be a single support member such as a plank of wood or a rectangular sheet of metal. Accordingly, the support platform may be any flat rectangular object with sufficient thickness to support a load.

When the support platform comprises multiple support members, the support members are preferably pivotally connected lengthwise by a hinge as shown by hinges 34. Hinges 34 permit support platform 30 to be folded lengthwise. Support platform 30 is folded by moving the substantially flat surface 31 of one support member 33 towards the substantially flat surface 31 of the other support member. Hinge 34 is an example of hinge means for enabling the support members to pivot such that the support platform may be folded lengthwise.

In general, the support platform of this invention can be configured to prevent rotation of an embodiment of the clamping means with respect to each ladder leg. More particularly, the support platform of this invention can provide structural stability to the scaffold of this invention when the width of the support platform is approximately the same as the length of the rung. This configuration enables the support platform to have contact engagement with the ladder legs above the rung on which the platform rests, thereby inhibiting the ability of the ladder legs to pivot with respect to the clamping means. Alternatively, or in addition, the support platform of this invention can provide structural stability by being attached to the rung on which it rests.

FIG. 1 also illustrates a stabilizing member 50. Each stabilizing member 50 has two opposing ends 51. Preferably, stabilizing member 50 is made of metal, but can be made of any suitable material. Stabilizing member 50 comprises two elongated bars 52 which are connected along their length by short connectors 53. Bars 52 are of sufficient strength to provide rigidity and stability to the scaffold once stabilizing member 50 is connected to end ladder 40. The length of stabilizing member 50 is determined by the length of bars 52. Bars 52 and connectors 53 may be rectangular, as shown, or have any suitable cross sectional shape. Another embodiment of stabilizing member 50 is an integral material having sufficient thickness to provide rigidity and stability to the scaffold such as a flat rectangular sheet of metal. Each end 51 of each stabilizing member 50 is connected to a clamping assembly 60.

FIG. 2 illustrates an enlarged perspective view of a particular embodiment of a clamping assembly 60. This embodiment of a clamping assembly comprises: a C-shaped jacket 61, a jacket retention pin 62 and sleeves 63. Such clamping assemblies are examples of clamping means for removably connecting the stabilizing member to an end ladder leg. Clamping assembly 60 may further comprise a locking pin as shown at 64.

Jacket 61 has a jacket opening 73 wide enough to permit end ladder leg 42 to fit inside jacket 61. Jacket 61 partially ensheathes end ladder leg 42 when the stabilizing member 50 is attached to an end ladder leg 42 via the clamping assembly 60. Jacket 61 permits end ladder leg 42 to rotate inside of jacket 61. Jacket 61 is preferably metal but may be made of any suitable material.

Jacket 61 is an example of jacket means for removably and partially ensheathing a portion of a ladder leg. The jacket means may have any suitable shape to partially ensheathe an end ladder leg and preferably to permit rotation of the jacket and the end ladder leg with respect to each other, but the preferred embodiment is a C-shaped jacket 61 partially ensheathing a square shaped end ladder leg 42. This embodiment is preferred as it allows easy pivoting. The length of embodiments of jacket means of this invention is such that ends 59 abut two rungs, thus stabilizing the scaffold in any of the scaffold's assembled configurations.

The embodiment of the jacket retention pin shown at 62 in FIG. 2 is U-shaped and has two arms 70. Each arm 70 is positioned slidably in two sleeves 63. FIG. 2 illustrates a jacket retention pin 62 after jacket retention pin 62 has been slid across jacket opening 73. Clamping assembly 60 is removably retained around end ladder leg 42 when jacket retention pin 62 is positioned across jacket opening 73.

Sleeve 63 is configured to permit U-shaped jacket retention pin 62 to slidably pass through sleeve 63. The embodiment of the stabilizing member shown in FIG. 2 has four sleeves attached to each end 51; two sleeves attached to the top of an end 51 of a stabilizing member 50, and two sleeves attached to the bottom of an end 51 of a stabilizing member 50. Sleeves 63 may be of any shape, but must allow jacket retention pin 62 to pass slidably through each sleeve. Each sleeve 63 illustrated in FIG. 2 is a small metal open ended cylinder permanently attached to an end 51 of a stabilizing member 50. Sleeves 63 guide jacket retention pin 62 as it slides to both open and close jacket opening 73.

The embodiment of a clamping assembly in FIG. 2 uses two springs 65 to hold jacket retention pin 62 across jacket opening 73. Each spring 65 is located between two of the sleeves 63 such that each arm 70 of U-shaped jacket retention pin 62 passes through two sleeves 63 and a spring 65. Each arm 70 has a catch 67 to engage the spring 65. Spring 65 engages against catch 67 and biases jacket retention pin 62 across jacket opening 73. Other embodiments may have another device, or no device, to bias jacket retention pin 62 toward jacket opening 73. Such springs are examples of biasing means for urging jacket retention pin across the jacket opening.

Jacket retention pin 62 is an example of jacket retention means for removably retaining the jacket around a portion of a ladder leg. Other embodiments of jacket retention means may have fewer sleeves or fewer arms. For example, jacket retention means may consist of a straight rod shaped pin that movably slides through one sleeve or that rotates in threaded engagement with at least one sleeve. The sleeves discussed herein are examples of sleeve means for supporting a jacket retention pin. In another embodiment of the jacket retention means of this invention, a straight rod shaped pin movably slides within and coaxially along end 51 of a stabilizing member.

Locking pin 64 prevents end ladder leg 42 from rotating inside of jacket 61. Locking pin 64 has an end for grasping 71 and a threaded end 72. Threaded end 72 also has a stop 66. Preferably, threaded end 72 of locking pin 64 is mated with a threaded aperture 69 on jacket 61. On the inside of jacket 61, the threaded aperture 69 has a recess 68. As locking pin 64 is being removed from jacket aperture 69, recess 68 provides space for stop 66 such that end ladder leg 42 may rotate freely. Stop 66 also retains the locking pin 64 in jacket aperture 69. The locking pin removably secures the clamping assembly to the end ladder leg to provide rigidity and stability to the scaffold. Locking pin 64 is an example of locking means for removably and rigidly securing the stabilizing member via the clamping means to the ladder leg.

FIG. 3 shows a top plan cross sectional view of clamping assembly 60. FIG. 3 also illustrates the function of jacket retention pin 62 and locking pin 64. End ladder leg 42 is retained inside jacket 61 by jacket retention pin 62. End ladder leg 42 is free to rotate when stop 66 located at the threaded end of locking pin 64 is within recess 68 on the inside of jacket 61. End ladder leg 42 is free to rotate when threaded end 72 of locking pin 64 is flush with the inside surface of jacket 61. End ladder leg 42 is rigidly and securely held in position when locking pin 64 is passed through aperture 69 on jacket 61. Locking pin 64 is advanced through aperture 69 on jacket 61 until end ladder leg 42 is no longer free to rotate. When locking pin 64 is in place, stabilizing member 50 is clamped to end ladder 40 via clamping assembly 60 and scaffold 20 is rigid and stable.

Figure 4A:
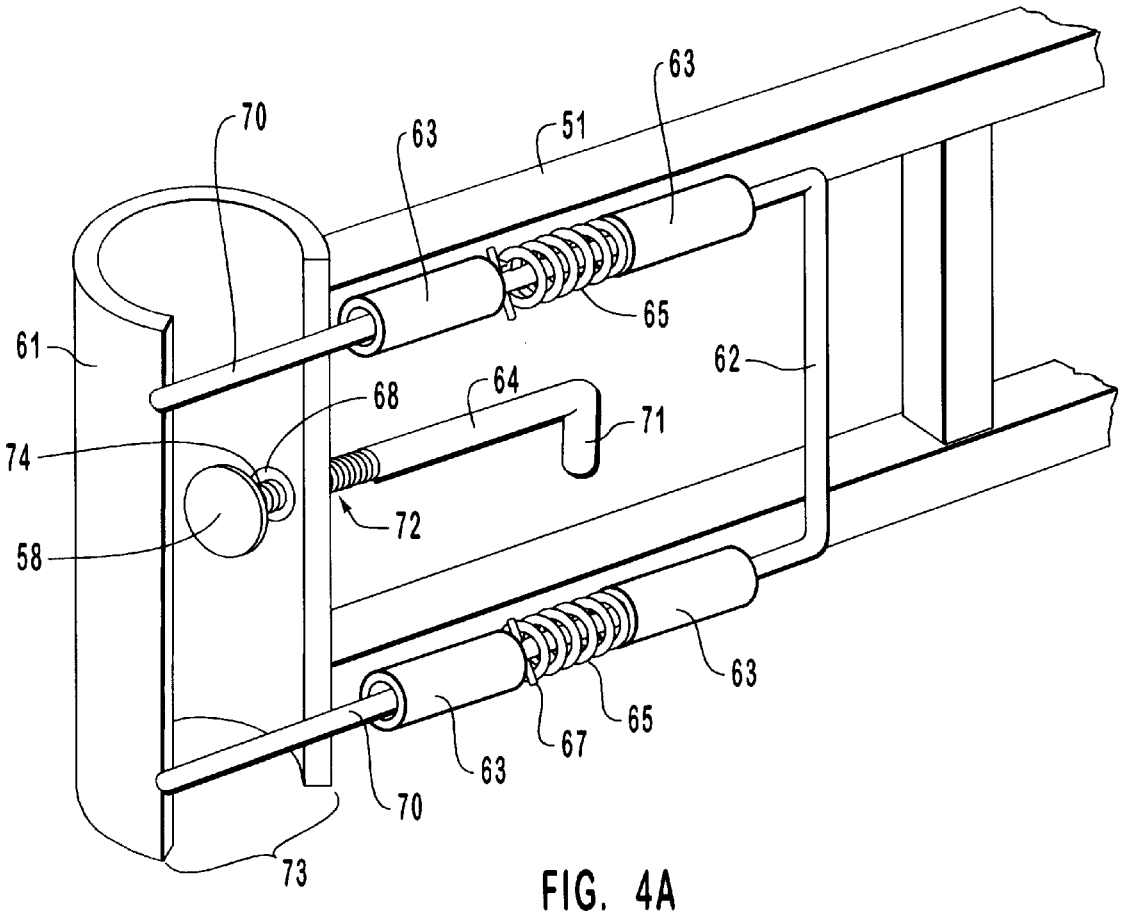
FIG. 4A illustrates a perspective view of an embodiment of the clamping assembly attached to the end of a stabilizing member, where the jacket retention pin is embodied by a threaded pin with a plate at one end.
Figure 4B:
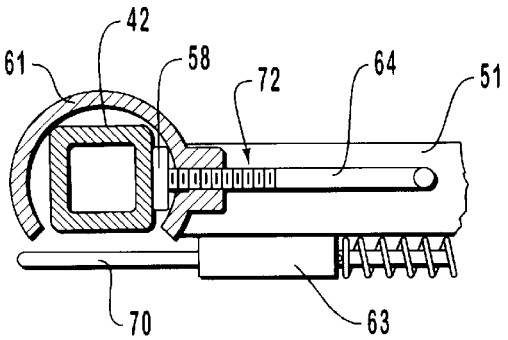
FIGS. 4B–4I show top plan cross sectional views of different embodiments of the clamping assembly and ladder leg of the scaffold of this invention.
Figure 4F:
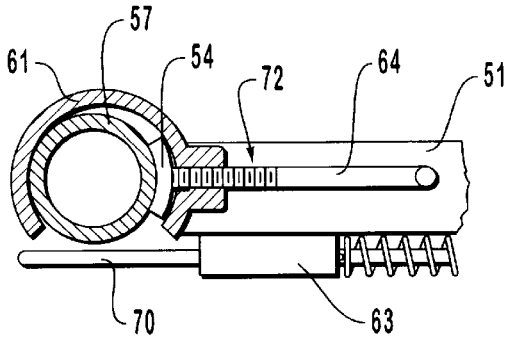

FIG. 4A shows an embodiment of the clamping assembly attached to the end of a stabilizing member where the jacket retention pin is embodied by a pin that is mated with a threaded aperture. In addition, end 74 of pin 64 in FIG. 4A features plate 58 for contact engagement with the ladder leg (not shown).

Figure 4C:
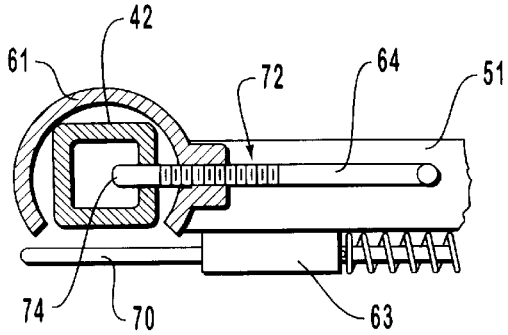
Figure 4G:
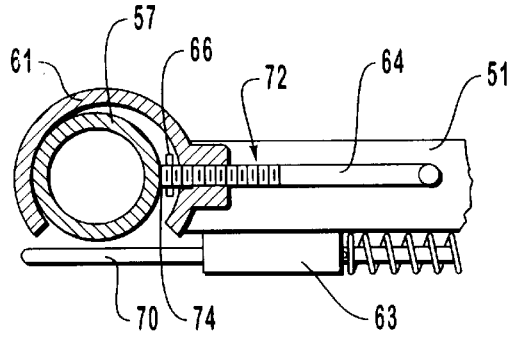
Figure 4D:
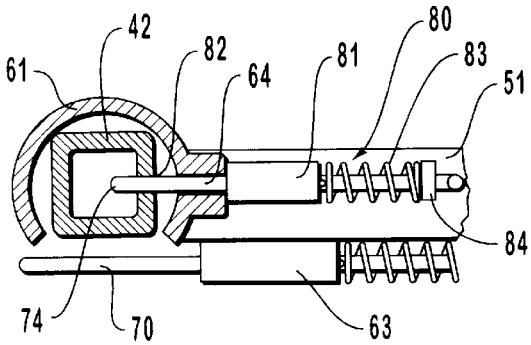
Figure 4H:
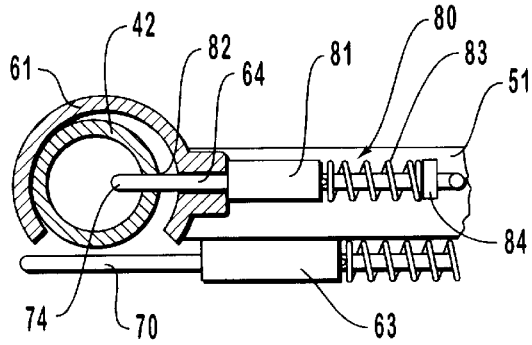

FIGS. 4B–4I show top plan cross sectional views of different embodiments of the clamping assembly and ladder leg of this invention. The embodiments shown in FIGS. 4B–4D and 4F–4H have a C-shaped jacket 61, whereas the embodiments shown in FIGS. 4E and 4I have jackets 55 and 56, respectively, with rectilinear sides. Although not shown in any of FIGS. 4A–4I, the jacket of the scaffold of this invention can be embodied by a jacket that features a combination of rectilinear and curved sides. As shown in FIGS. 4E–4I, the ladder legs of the scaffold of this invention can have a non-square cross-section, such as annular cross-section 57. As shown in FIGS. 4C, 4D, and 4H, end ladder leg 42 may also be configured with apertures to receive locking pin 64. When the end ladder leg has such apertures, locking pin 64 may be configured to slide through a threaded or non-threaded jacket aperture when the jacket aperture is aligned with the end ladder leg aperture. For example, pin 64 in FIG. 4C may be threaded along its length up to end 74 so that it can be threadably engaged by a threaded aperture in the ladder leg.

Figure 4E:
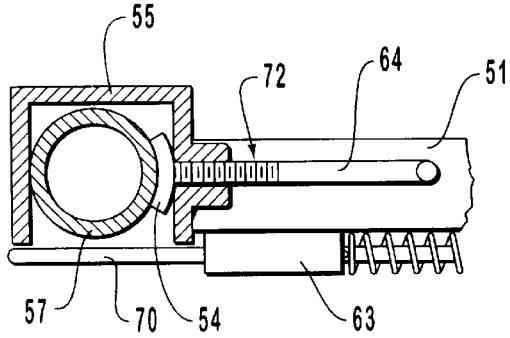
Figure 4I:
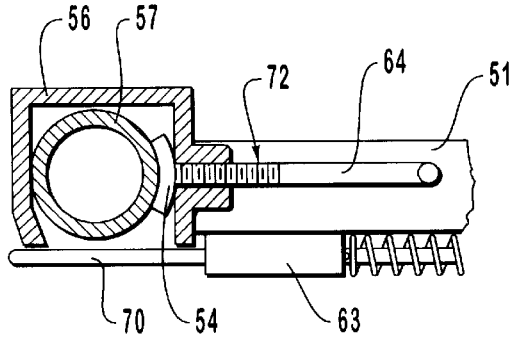

As shown in FIGS. 2, 3, 4A–4C, 4E–4G and 4I, the locking pin in the scaffold of this invention preferably has a threaded end 72 that engages jacket 61 in the embodiments shown in FIGS. 2, 3, 4A–4C, 4F–4H, and jackets 55 and 56 in FIGS. 4E and 4I, respectively. In other embodiments of this invention, locking pin 64 engages the jacket of the scaffold of this invention, such as jacket 61 as shown in FIGS. 4D and 4H, with the aid of spring loaded mechanism 80 that is preferably attached to an embodiment of the jacket such as jacket 61. Spring loaded mechanism 80 comprises sleeve 81 that guides locking pin 64 in its axially sliding motion in and out of aperture 82 in end ladder leg 42 or 57, spring 83, and spring arrester 84.

In addition, to the engagement between locking pin 64 and ladder leg 42 that is shown in FIG. 3, this engagement can be achieved in a variety of configurations such as those exemplarily shown in FIGS. 4A–4I. Contact engagement is achieved in the embodiments shown in FIGS. 4A and 4B with the aid of flat plate 58 whereas it is achieved with the aid of curved plate 54 in the embodiments shown in FIGS. 4F, 4E, and 4I. In another type of contact engagement, locking pin 64 abuts against ladder legs 42 or 57 in the embodiments shown in FIGS. 3 and 4G, respectively. In still another type of contact engagement, end 74 of locking pin 64 slides into ladder legs 42 or 57 in the embodiments shown in FIGS. 4D and 4H, or threadably penetrates into ladder leg 42 as shown in FIG. 4C.

Figure 5A:
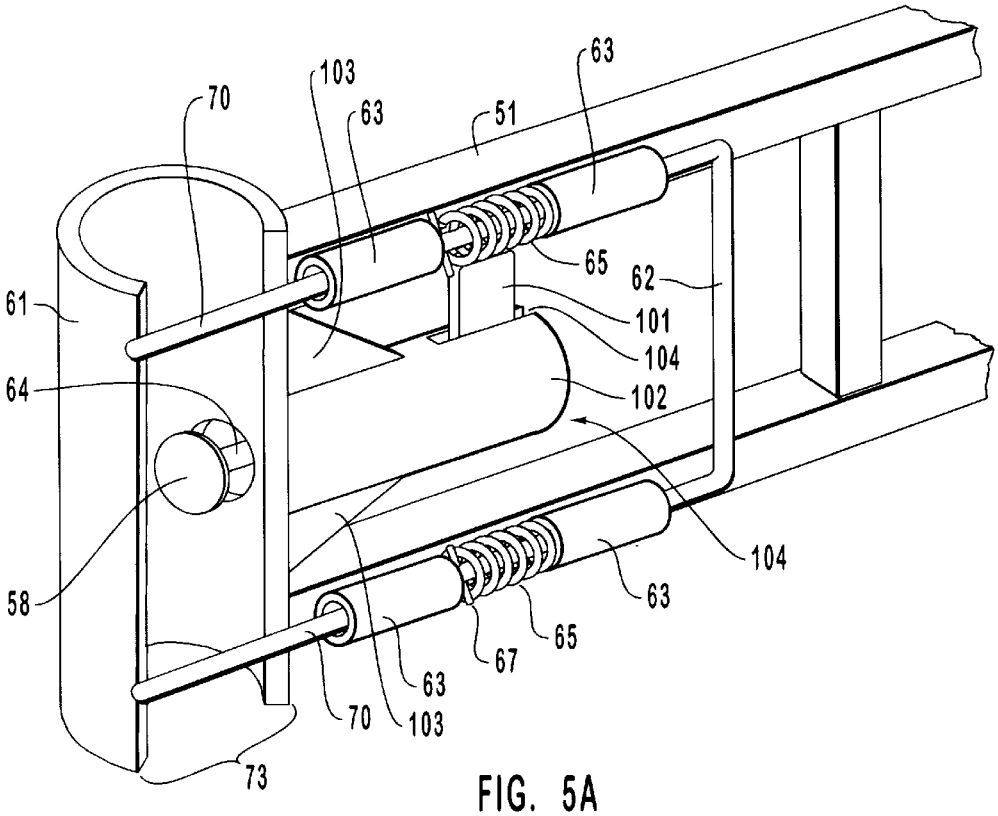
FIG. 5A illustrates a perspective view of an embodiment of the clamping assembly attached to the outside of a C-shaped jacket at the end of a stabilizing member, where the jacket retention pin is embodied by a pin with a plate at one end and the lever is in one locking position.

FIG. 5A shows a perspective view of an embodiment of the clamping assembly where the jacket retention pin is embodied by a spring loaded pin that features plate 58 at one of its ends for contact engagement with the ladder leg. The other end of the spring loaded pin is engaged with an activation mechanism that is embodied in the example shown in FIG. 5A by a cam and lever system. Lever 101 as shown in FIG. 5A is in one of the positions that force plate 58 into contact engagement with the ladder leg. Housing 102 contains pin 64 and part of the cam and lever system and it is attached to the outer wall of jacket 61, preferably with the aid of plates 103. In embodiments with no plate 58 at the end of pin 64, lever 101 in any of the position shown in FIG. 5A causes the engagement of the end of pin 64 with the ladder leg.

Figure 5B:
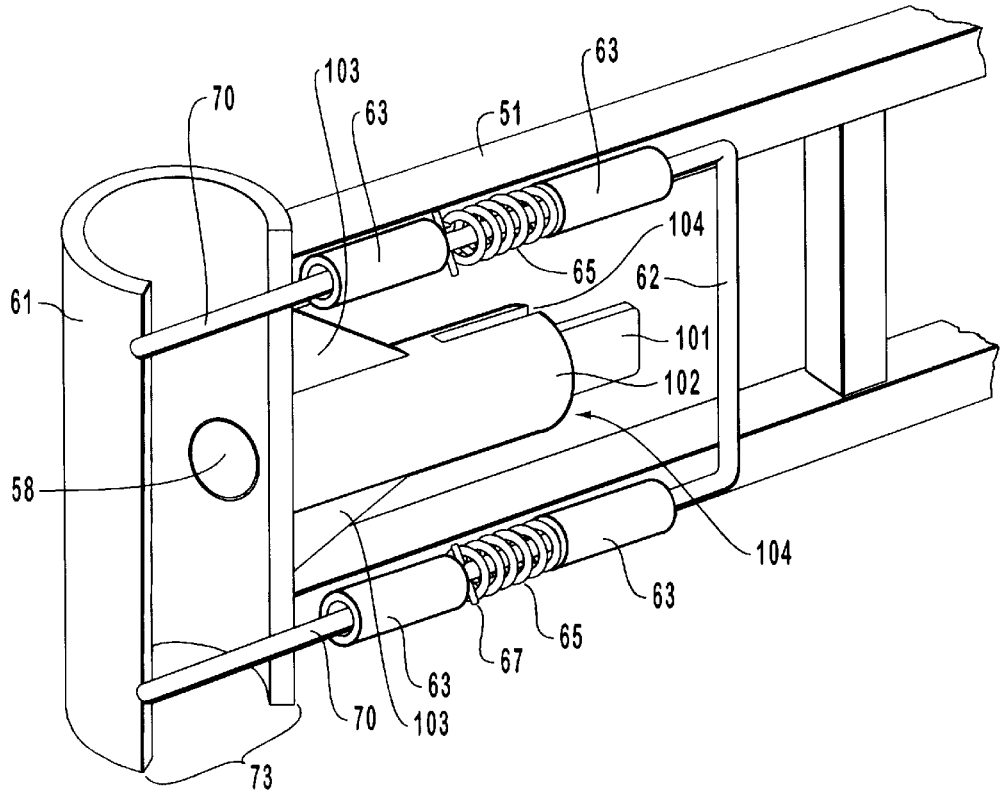
FIG. 5B illustrates a perspective view of an embodiment of the clamping assembly like the embodiment shown in FIG. 5A, but the lever here is shown in a position that causes the retraction from the locking position illustrated in FIG. 5A.

FIG. 5B shows the embodiment depicted in FIG. 5A with lever 101 in a position that causes plate 58 to retract from its contact engagement with the ladder leg. To prevent rotations of lever 101 about the longitudinal axis of housing 102, lever 101 is preferably restrained by top and bottom slots 104 (bottom slot hidden in perspective view shown in FIGS. 5A–5B).

Figure 5C:
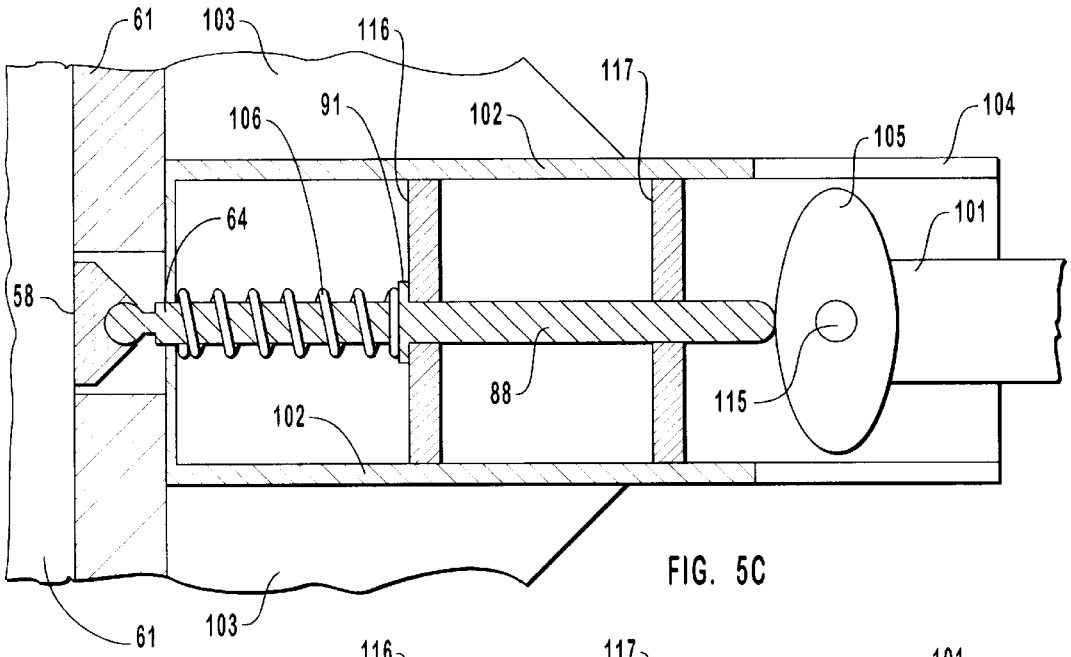
FIG. 5C illustrates a partial cross sectional view of the embodiment shown in FIGS. 5A and 5B, depicting the cam and lever system, where the lever is positioned to release the contact engagement between the end of the pin and the jacket.

FIG. 5C shows a partial cross-sectional view of an embodiment of housing 102, pin 88, and cam 105 and lever 101. Spring mechanism 106 keeps pin 88 in a disengaged position where lever 101 orients cam 105 as shown in FIG. 5C. The configuration of the cam and lever system shown in FIG. 5D corresponds with the perspective view shown in FIG. 5A, and that shown in FIG. 5C corresponds with the perspective view shown in FIG. 5B.

Figure 5D:
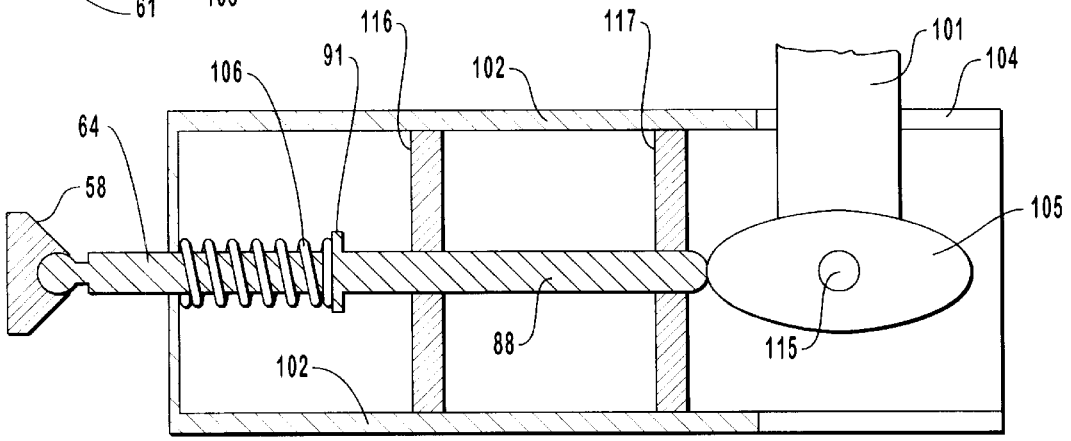
FIG. 5D illustrates a partial cross-sectional view showing the cam and lever system of the embodiment shown in FIG. 5A.
Figure 5E:
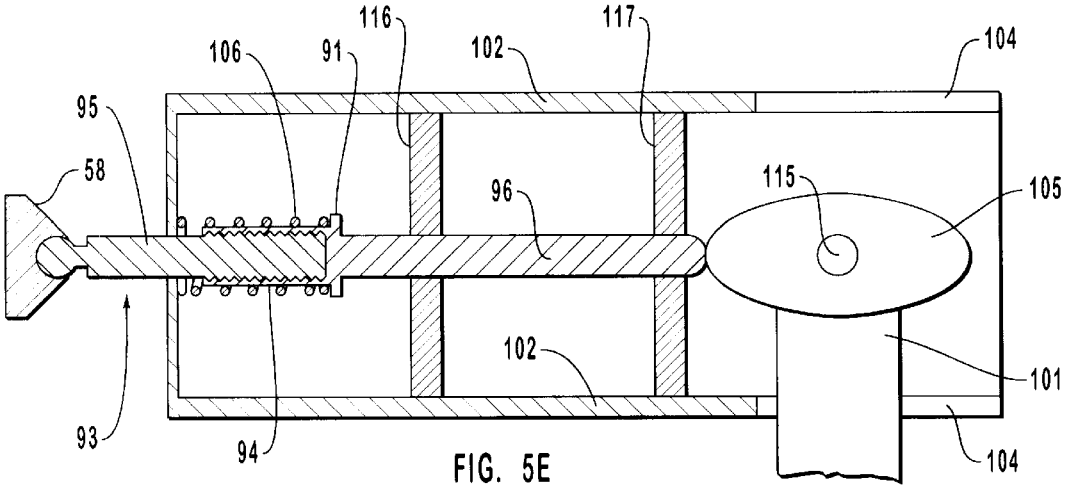
FIG. 5E illustrates a partial cross-sectional view of an embodiment like the embodiment depicted in FIG. 5B, showing the cam and lever system with an adjustable length pin.

FIG. 5E shows another configuration of the cam and lever system that forces plate 58 into contact engagement with the ladder leg. In other embodiments of this invention, the cam and lever system can be configured in two limit positions, one to force plate 58 into contact engagement with the ladder leg and another to release such engagement.

FIG. 5E shows an embodiment of an adjustable length pin 93 with a leading portion 95 that can be screwed out/in trailing portion 96. Surface 58 in any of FIGS. 5A–5E is only an exemplary embodiment of the feature at the end of the pin that engages the ladder leg. Other embodiments of pin 88 can have this end shaped with any of the features 54, 58, or 74 shown in FIGS. 4B, 4D or 4E.

FIGS. 5C–5E illustrate how the cam and lever system actuate on the spring loaded pin. In a distended position, spring 106 retracts pin 88 into housing 102 and away from the ladder leg until pin 88 is stopped by an arresting mechanism that is exemplarily embodied in FIGS. 5C–5E by flange 91 and arrester 116. Flange 91 and/or arrester 116 can be embodied by structures of annular cross section or by structures that come into contact engagement when pin 88 is pushed by distending spring 106 away from the ladder leg. To force surface 58 into contact engagement with the ladder leg, lever 101 is actuated so that cam 105 pushes pin 88 as shown in FIG. 5D towards the ladder leg.

As shown in FIGS. 5B–5C, when pin 88 is in a retracted position, plate 58 is flush or nearly flush with the inner surface of jacket 61. In addition, the generally cylindrical passage in jacket 61 that allows for the sliding movement of pin 88 can be shaped in other embodiments of this invention with a feature that provides an additional arresting surface for the end of pin 88.

Optionally, guide 117 shown in FIGS. 5C–5E provides additional support for pin 88. This is a preferred feature for embodiments of this invention with large housing 102.

FIG. 6A shows a perspective view of an embodiment of the clamping assembly with sleeve 90, and cam 86 and lever 87 system attached to a stabilizing member.

FIGS. 6B–6D show cross sectional views of different embodiments of the spring loaded pin with cam and lever system shown in FIG. 6A. FIGS. 6B and 6C illustrate how the cam and lever system actuate on the spring loaded pin. In a distended position, spring 89 retracts pin 88 into sleeve 90 and away from the ladder leg (not shown in FIGS. 6B–6D) until pin 88 is stopped by an arresting mechanism that is exemplarily embodied in FIGS. 6B–6D by flange 91 and arrester 92. Flange 91 and/or arrestor 92 can be embodied by structures of annular cross section or by structures that come into contact engagement when pin 88 is pushed by distending spring 89 away from the ladder leg. To force surface 58 into contact engagement with the ladder leg, lever 87 is actuated so that cam 86 pushes pin 88 as shown in FIG. 6C towards the ladder leg. It is understood that surface 58 is only an exemplary embodiment of the feature at the end of pin 88 that engages the ladder leg and other embodiments of pin 88 can have this end shaped with any of the features 54, 58, or 74 shown in FIGS. 4B, 4D or 4E.

Because the jacket and the ladder leg of the scaffold of this invention are not necessarily uniform in size, a pin with a variable and adjustable length may be a preferred embodiment when jackets and/or legs of various sizes are used. The exemplary embodiment of variable length pin 93 shown in FIG. 6D comprises a pin with two threadably mated portions at threaded engagement 94. This threaded engagement permits the extension of pin 93 by screwing out leading portion 95 with respect to trailing portion 96 of pin 93. It is understood that a pin with variable and adjustable length can also be embodied by the pin in any of the embodiments shown in FIGS. 4A–4I.

Any of the embodiments of the cam of this invention is rotatably fixed with the aid of a device that allows for adequate pivoting of the cam. This device is embodied by pivot pin 115 in the embodiments shown in FIGS. 5C–5E, 6A–6D.

FIG. 7 is a top plan cross sectional view of the scaffold depicting the benefits of the hinged configuration resulting from engagement of the clamping mechanism around the ladder legs. More particularly, FIG. 7 illustrates how the scaffold folds or collapses to enable the scaffold to be quickly moved to another location. In FIG. 7, scaffold 20 is not in a locked and rigid position. Each end ladder leg 42 is free to rotate inside of jacket 61. Jacket retention pin 62 is movably held across jacket opening 73 such that stabilizing member 50 is retained around end ladder leg 42. Stabilizing members 50 on one side of scaffold 20 are pushed toward stabilizing members 50 on the other side of scaffold 20 to fold or collapse scaffold 20. In a collapsed or folded configuration, scaffold 20 is capable of being easily maneuvered through narrow openings. Scaffold 20 is unfolded by separating opposing stabilizing members 50 until end ladders 40 are perpendicular to stabilizing members 50. Next, locking pins 64 are engaged to rigidly secure scaffold 20.

The term "collapsed" as applied to the scaffold of this invention describes the configuration in which the scaffold is in any form similar to that shown in FIG. 7 and it has sufficient structural integrity as to be maneuvered around. Consequently, "collapsed" when applied to the scaffold of this invention does not mean that the scaffold is fully disassembled.

FIG. 8 is a perspective view of the assembled scaffold ready for use. The configuration in FIG. 8 is a single unit. End ladders 40 have a caster wheel assembly 45 attached to provide mobility. End ladders 40 are connected to stabilizing members 50 via clamping assemblies 60 which provides a rigid support frame. Support platform 30 includes two pivotally connected support members 33. In this particular embodiment, support platform 30 is attached to a middle rung 41 of end ladder 40. An additional stabilizing member 50 is attached to end ladders 40 at a point higher than support platform 30. This provides additional safety, rigidity and support to scaffold 20. FIG. 8 also illustrates how scaffold 20 may be easily ascended. The more narrow support member 33 shown in FIG. 8 is folded over allowing a worker to easily ascend scaffold 20. After the worker has ascended scaffold 20, the more narrow support member 33 is unfolded to provide a wider working surface. FIG. 8 is an illustration of how the scaffold may be assembled.

FIG. 9 is a perspective view of the modularity and storability of end ladders 40 and stabilizing members 50. The components used to construct scaffold 20 are compactly stored because the components are removable and modular. Scaffold 20 is not one permanently connected unit. The removable stabilizing members 50 may be stored by stacking them on top of each other. The rectangular shape of the stabilizing members 50 permits the stacking to be done efficiently in the least amount of space. Similarly, the rectangular shape of the end ladders also permits efficient storage while occupying a minimal amount of space.

FIG. 10 is a perspective view of another scaffold 20 configuration. FIG. 10 illustrates how individual scaffold 20 units can be stacked to provide a working surface at a higher elevation.

The illustration in FIG. 10 uses four modular end ladders 40. Two of the end ladders 40 are stacked on the other two end ladders 40 by inserting the top ends 43 of the lower ladder legs 42 into the bottom ends 44 of the upper ladder legs 42. The ladders connect at joint 46. A plurality of stabilizing members 50 are connected via clamping assemblies 60 to stacked end ladders 42. Support platform 30 is connected to rungs 41 of the upper end ladders 40. Stacked scaffold units that are rigid and secure, and the stacked scaffold units may also be folded. The scaffold assembled in FIG. 10 is easily movable because the scaffold assembly in FIG. 10 can be collapsed just like the scaffold unit described above and shown in FIG. 7. FIG. 10 also illustrates how stabilizing members 50 permit a worker to climb to the top of the structure. Stabilizing members 50 are used like steps of a ladder. The stabilizing member used in all of the embodiments of the invention may be stood on or climbed.

As shown in FIG. 10, each bottom end 44 of ladder leg 42 has an upward extending aperture. This aperture is configured to receive the top end 43 of another ladder leg 42. End ladders 40 are stacked by inserting the top end 43 of each ladder leg 42 into the aperture in the bottom end 44 of another end ladder 40. The bottom end 44 of each ladder leg 42 is configured for dual functions as it may also be coupled with a caster wheel assembly 45 in the same way a bottom end 44 couples with a top end 43 of another end ladder 40. The optional caster wheels 45 facilitate movement of the scaffold.

Top ends 43 and bottom ends 44 are shown in FIG. 10 with corresponding orifices 110 for receiving a holding pin such as pin 111. Orifices 110 and pins 111 are exemplarily shown in the embodiment depicted in FIG. 10, but they can be part of any other embodiment of this invention, and they provide additional stability by securing any pair of mating structures, such as top ends 43 and bottom ends 44 or bottom ends 44 and caster wheel assemblies 45.

FIG. 11 is a perspective view of another foldable scaffold in a step configuration. This embodiment shows how support platform 30 and support members 33 can be used to create a step configuration. End ladders in this embodiment are wider to accommodate the extra support members needed to form steps. Support members 33 are arranged to form steps up to support platform 30 by connecting support members 33 to successively higher rungs 41 on end ladders 40. The embodiment in FIG. 11 shows support platform 30 to include three support members 33 connected pivotally by hinges. One support member 33 is folded over to provide easy ascension by a worker. A worker ascends this embodiment by using the support members as steps. Once a worker has ascended the scaffold shown in FIG. 11, the folded support member 33 is unfolded to provide a wider support platform 30.

FIG. 12 is a perspective view of another embodiment of the present invention. The components are essentially similar to the other embodiments while the end ladders shown at 140 are unique. End ladders 140 are primarily unique due to the use of a top rung 141, side rungs 148 having varying lengths and an arch shown at 147 which is connected to top rung 141 and side rungs 148. Top rung 141 and side rungs 148 are located between two vertically extending ladder legs 142. A portion of each arch 147 extends downward from the top rung 141 to provide support at one end of each rung 148 and another integral portion of each arch attaches to each respective ladder leg 142. The portion of arch 147 adjacent to ladder leg 142 may be used as the lowermost rung. Top rung 141 extends horizontally between and attaches to both end ladder legs 142. Side rungs 148 extend horizontally between end ladder legs 142 but do not connect to each end ladder leg 142. The different lengths of side rungs 148 provide benefits in many situations, particularly in masonry projects.

In FIG. 12, support platform 30 engages the uppermost rung 141. In this embodiment, end ladder legs 142 have a circular cross sectional shape. If more stability is required, extra stabilizing members 50 can be added to the scaffold structure.

Figure 13:
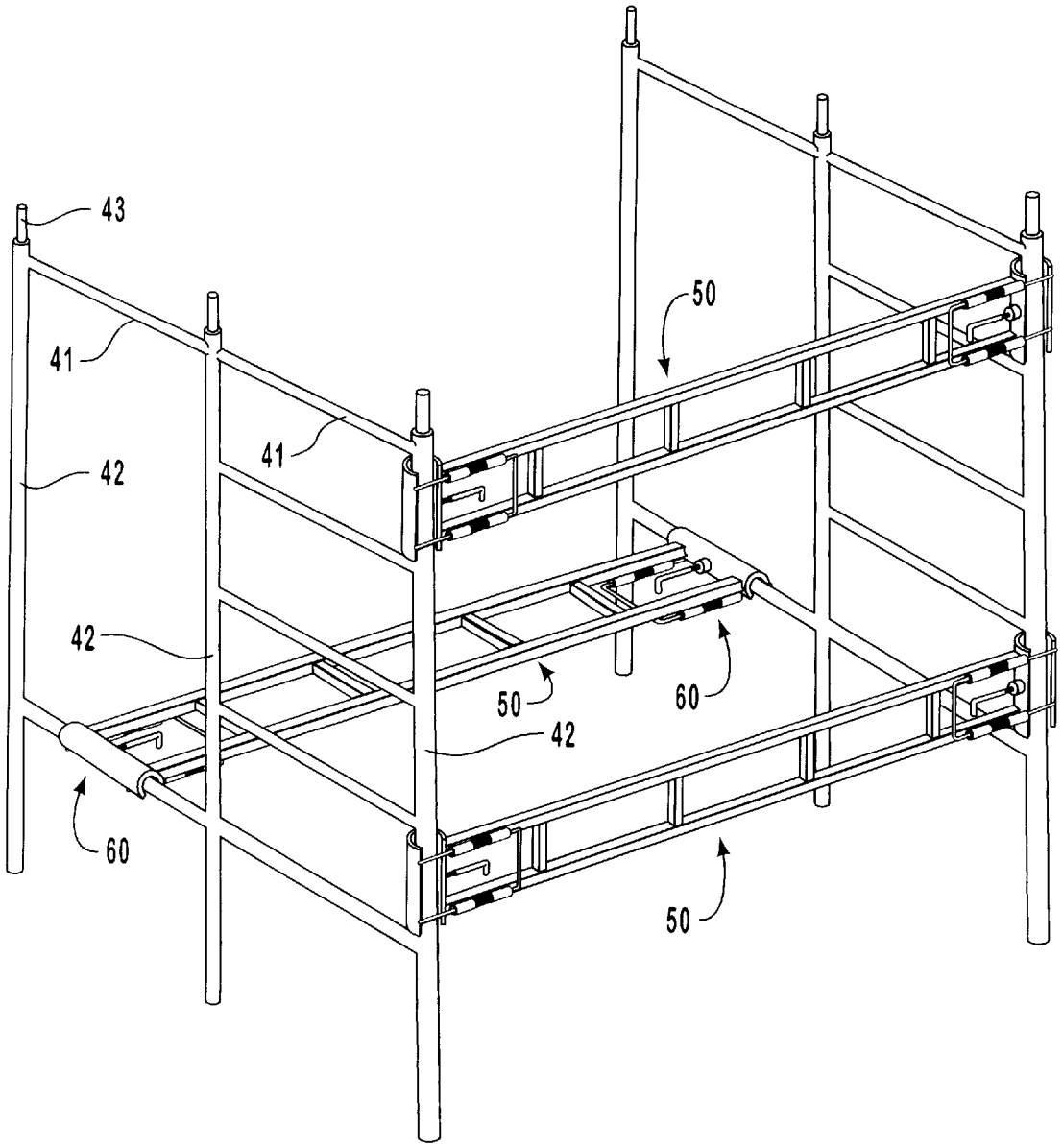
FIG. 13 illustrates a perspective view of another embodiment of the foldable scaffold.

FIG. 13 is a perspective view of another embodiment of scaffold 20. End ladders 40 in this embodiment has three end ladder legs 42. A plurality of rungs 41 extend horizontally between consecutive end ladder legs 42. In this embodiment, stabilizing member 50 also serves as a support platform and clamping assembly 60 is another example of attachment means. In other embodiments, end ladder 40 may have a plurality of end ladder legs 42 and a plurality of end ladder rungs 41 may extend between each opposing end ladder leg 42.

The modular support platform 30, end ladders 40 and stabilizing members 50 allow for a multitude of different embodiments. The foldable scaffold described above may be adapted to a specific need, folded and easily moved, assembled and disassembled quickly and stored compactly and efficiently, while providing the rigidity and stability of conventional scaffolds.

The present invention may be embodied in other specific forms without departing from its spirit or essential characteristics. The described embodiments are to be considered in all respects only as illustrated and not restrictive. The scope of the invention is, therefore, indicated by the appended claims rather than by the foregoing description. All changes which come within the meaning and range of equivalency of the claims are to be embraced within their scope.

What is claimed and desired to the secured by United States Letters Patent is:

1. A modular, hinged scaffold unit comprising:

at least two opposing modular end ladders, each end ladder having a plurality of horizontal rungs between two vertically extending ladder legs, wherein each ladder leg has a top end and a bottom end;

a support platform having a substantially flat surface and two opposing ends, each opposing end resting on one of the horizontal rungs in a removable configuration such that the support platform extends horizontally between the two end ladders; and at least two horizontal stabilizing members, wherein each stabilizing member has two opposing ends, wherein each end of each stabilizing member has a rotatable clamping means for removably and rotatably connecting each stabilizing member to one of the ladder legs, wherein each clamping means includes jacket means for removably and partially ensheathing a portion of the ladder leg, the jacket means including a jacket opening extending the length thereof, wherein the jacket means is rotatable about the ladder leg, and jacket retention means for removably retaining the jacket means around a portion of the ladder leg by being moved across the jacket opening such that each clamping means is removably connected to one of the ladder legs, whereby each horizontal stabilizing member is connected to the ladder legs and each horizontal stabilizing member pivots with respect to the ladder legs when the scaffold unit is collapsed for maneuvering and whereby each horizontal stabilizing member is in a perpendicular configuration with respect to the horizontal rungs of each of the two modular end ladders when the scaffold unit is assembled for use.

2. A modular, hinged scaffold unit as in claim 1, wherein each top end of each ladder leg is configured to couple with a bottom end of another ladder leg.

3. A modular, hinged scaffold unit as in claim 1, wherein each opposing end of each horizontal stabilizing member snugly fits between two adjacent end ladder rungs thereby contributing to the structural stability of the scaffold unit.

4. A modular, hinged scaffold unit as in claim 1, wherein the bottom end of a ladder leg is configured to receive a caster wheel assembly.

5. A modular, hinged scaffold unit as in claim 1, wherein the support platform includes at least two support members, wherein each support member is pivotally connected to another support member.

6. A modular, hinged scaffold unit as in claim 1, wherein the support platform includes at least two support members, wherein each support member is connected to another support member by hinge means for enabling the support members to pivot such that the support platform may be folded lengthwise.

7. A modular, hinged scaffold unit as in claim 1, wherein each opposing end of the support platform has attachment means for removably connecting the support platform to a rung of an end ladder.

8. A modular, hinged scaffold unit as in claim 1, further comprising a plurality of support platforms resting on different rungs such that the plurality of support platforms are in a step configuration.

9. A modular, hinged scaffold unit as in claim 1, wherein the clamping means further includes:

locking means for securing and releasing the jacket means with respect to the ladder leg.

10. A modular, hinged scaffold unit as in claim 9, wherein the locking means comprises a pin that slidably engages the ladder leg.

11. A modular, hinged scaffold unit as in claim 9, wherein the locking means comprises a pin that abuts the ladder leg.

12. A modular, hinged scaffold unit as in claim 9, wherein the locking means comprises a pin that threadably engages the ladder leg.

13. A modular, hinged scaffold unit comprising:

at least two opposing modular end ladders, each end ladder having a plurality of horizontal rungs between two vertically extending ladder legs, wherein each ladder leg has a top end and a bottom end;

a support platform having a substantially flat surface and two opposing ends, each opposing end resting on one of the horizontal rungs in a removable configuration such that the support platform extends horizontally between the two end ladders; and at least two horizontal stabilizing members, wherein each stabilizing member has two opposing ends, wherein each end has a rotatable clamping means for removably and rotatably connecting each stabilizing member to an end ladder leg, wherein each clamping means includes jacket means for removably and partially ensheathing a portion of the ladder leg in a rotatable configuration, the jacket means including a jacket opening extending the length thereof, jacket retention means for removably retaining the jacket means around a portion of the ladder leg by being moved across the jacket opening such that each clamping means is removably connected to one of the ladder legs, and locking means for securing and releasing the jacket means with respect to the ladder leg, whereby when the locking means engages the ladder leg, the horizontal stabilizing members are prevented from rotating with respect to the ladders legs and the scaffold unit is assembled for use with the horizontal stabilizing members in a perpendicular configuration with respect to the horizontal rungs of each of the opposing modular end ladders, whereby releasing each locking means enables the horizontal stabilizing members to rotate with respect to the ladder legs to which the horizontal stabilizing members are connected in order to collapse the scaffold unit.

14. A modular, hinged scaffold unit comprising:

at least two opposing modular end ladders, each end ladder having a plurality of horizontal rungs between two vertically extending ladder legs, each ladder leg having a top end and a bottom end;

a support platform having a substantially flat surface and two opposing ends, each opposing end resting on one of the horizontal rungs in a removable configuration such that the support platform extends horizontally between the two end ladders; and at least two horizontally stabilizing members, wherein each stabilizing member has two opposing ends, wherein each end has a clamp assembly configured for attachment to a ladder leg and for rotation with respect to the ladder leg, wherein each clamp assembly includes a jacket connected to an end of a stabilizing member, wherein the jacket has an opening extending the length thereof such that the jacket only partially ensheathes a portion of a ladder leg, wherein the jacket is rotatable about the ladder leg; and a jacket retention pin movably positioned in at least one sleeve connected to an end of a stabilizing member such that the jacket retention pin moves across the opening of the jacket such that each clamp assembly is removably attached to one of the ladder legs, whereby each horizontal stabilizing member is attached to the opposing modular end ladders and each horizontal stabilizing member pivots with respect to the ladder legs to which the horizontal stabilizing members are attached when the scaffold unit is collapsed and whereby the horizontal stabilizing member is in a perpendicular configuration with respect to the horizontal rungs of each of the two modular end ladders when the scaffold unit is assembled for use.

15. A modular, hinged scaffold unit as in claim 14, wherein each top end of each ladder leg is configured to couple with a bottom end of another ladder leg.

16. A modular, hinged scaffold unit as in claim 14, wherein the support platform includes at least two support members, wherein each support member is connected to another support member by hinge means for enabling the support members to pivot such that the support platform may be folded lengthwise.

17. A modular, hinged scaffold unit as in claim 14, wherein the support platform includes at least two support members, wherein each support member is pivotally connected to another support member by hinges.

18. A modular, hinged scaffold unit as in claim 14, wherein each opposing end of the support platform has attachment means for removably connecting the support platform to a rung of an end ladder.

19. A modular, hinged scaffold unit as in claim 14, wherein the jacket retention pin is movably positioned in at least two sleeves and the jacket retention pin passes through a spring positioned between the two sleeves, wherein the jacket retention pin has a catch located to engage the spring such that the jacket retention pin is biased toward the opening of the jacket to ensure that the jacket is retained around the ladder leg.

20. A modular, hinged scaffold unit as in claim 14, wherein each clamp assembly further comprises a locking pin, wherein the locking pin passes through an aperture in the jacket to removably and rigidly secure the stabilizing member via the clamp assembly to the ladder leg.

21. A modular, hinged scaffold unit as in claim 14, wherein the jacket retention pin is a pin that slidably engages the ladder leg.

22. A modular, hinged scaffold unit as in claim 14, wherein the jacket retention pin is a pin that abuts the ladder leg.

23. A modular, hinged scaffold unit as in claim 14, wherein the jacket retention pin is a pin that threadably engages the ladder leg.

24. A modular, hinged scaffold unit comprising:

at least two opposing modular end ladders having a plurality of horizontal rungs between two vertically extending ladder legs, each ladder leg having four sides such that the cross-sectional shape is rectangular, each ladder leg having a top end and a bottom end;

a support platform having a substantially flat surface and two opposing ends, each opposing end resting on one of the horizontal rungs in a removable configuration such that the support platform extends horizontally between the two end ladders; and at least two horizontal stabilizing members, wherein each stabilizing member has two opposing ends, wherein each end has a clamp assembly configured for removable attachment to a ladder leg, wherein each clamp assembly includes a C-shaped jacket connected to an end of a stabilizing member, wherein the jacket has an opening extending the length thereof such that the jacket only partially ensheathes a portion of a ladder leg, wherein the jacket is rotatable about the ladder leg, a U-shaped jacket retention pin having two arms, each arm of the U-shaped jacket retention pin is slidable within at least one sleeve, wherein each sleeve is connected to an end of a stabilizing member such that each arm of the U-shaped jacket retention pin slides across the opening of the C-shaped jacket to enable the C-shaped jacket to be removably attached to one of the ladder legs, and a locking pin extending through the C-shaped jacket such the locking pin alternatively secures and releases the C-shaped jacket with respect to the ladder leg, whereby when the locking pin engages the ladder leg, the horizontal stabilizing members are prevented from rotating with respect to the ladder legs and the scaffold unit is assembled for use with the horizontal stabilizing members in a perpendicular configuration with respect to the horizontal rungs of each of the two modular end ladders, and whereby releasing each locking pin enables the horizontal stabilizing members to rotate with respect to the ladder legs to which the horizontal stabilizing members are attached in order to collapse the scaffold unit.

25. A modular, hinged scaffold unit comprising:

at least two opposing modular end ladders, each end ladder having a plurality of horizontal rungs between two vertically extending ladder legs, wherein each ladder leg has a top end and a bottom end;

a support platform having a substantially flat surface and two opposing ends, each opposing end resting on one of the horizontal rungs in a removable configuration such that the support platform extends horizontally between the two end ladders; and at least two horizontal stabilizing members, wherein each stabilizing member has two opposing ends, wherein each end has a rotatable clamping assembly for removably and rotatably connecting each stabilizing member to an end ladder leg, wherein each clamping assembly includes a jacket connected to an end of a stabilizing member, wherein the jacket has an opening extending the length thereof, such that the jacket only partially ensheathes a portion of a ladder leg, wherein the jacket is rotatable about the ladder leg;

a jacket retention pin movably positioned in at least one sleeve connected to an end of a stabilizing member such that the jacket retention pin moves across the opening of the jacket such that each clamp assembly is removably attached to one of the ladder legs, and a locking pin extending through the jacket such that the locking pin alternatively secures and releases the jacket with respect to the ladder leg, whereby when the locking pin engages the ladder leg, the horizontal stabilizing members are prevented from rotating with respect to the ladder legs and the scaffold unit is assembled for use with the horizontal stabilizing members in a perpendicular configuration with respect to the horizontal rungs of each of the two modular end ladders, and whereby releasing each locking pin enables the horizontal stabilizing members to rotate with respect to the ladder legs to which the horizontal stabilizing members are attached in order to collapse the scaffold unit.

26. A modular, hinged scaffold unit as in claim 25, wherein each arm of the jacket retention pin is slidably positioned in at least two sleeves are each arm of the jacket retention pin passes through a spring positioned between the two sleeves, wherein each arm of the jacket retention pin has a catch located to engage the spring such that the jacket retention pin is biased toward the opening of the jacket to ensure that the jacket is retained around the ladder leg.

27. A modular, hinged scaffold unit as in claim 25, wherein the locking means comprises:

a locking pin having two ends, one end configured for grasping and a threaded end configured to be mated within a threaded aperture in the jacket.

28. A modular, hinged scaffold unit as in claim 25, wherein the locking means comprises:

a locking pin having two ends, one end configured for grasping and a threaded end configured to be mated with a threaded aperture in the jacket, wherein the locking pin has a stop extending from the threaded end to prevent removal of the locking pin from the aperture in the jacket.

* * * * *